US009200632B2

(12) United States Patent
Inoue et al.

(10) Patent No.: US 9,200,632 B2
(45) Date of Patent: Dec. 1, 2015

(54) SCREW COMPRESSOR WITH SLIDE VALVE INCLUDING A SEALING PROJECTION

(75) Inventors: Takashi Inoue, Osaka (JP); Masanori Masuda, Osaka (JP); Hiromichi Ueno, Osaka (JP); Mohammod Anwar Hossain, Osaka (JP); Akira Matsuoka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 13/820,067

(22) PCT Filed: Sep. 29, 2011

(86) PCT No.: PCT/JP2011/005516

§ 371 (c)(1),
(2), (4) Date: Feb. 28, 2013

(87) PCT Pub. No.: WO2012/042891

PCT Pub. Date: Apr. 5, 2012

(65) Prior Publication Data

US 2013/0171018 A1 Jul. 4, 2013

(30) Foreign Application Priority Data

Sep. 30, 2010 (JP) ..... 2010-222170

(51) Int. Cl.

| | |
|---|---|
| ***F04C 18/16*** | (2006.01) |
| ***F04C 18/00*** | (2006.01) |
| ***F04C 18/52*** | (2006.01) |
| ***F04C 28/12*** | (2006.01) |

(52) U.S. Cl.

CPC ..... *F04C 18/00* (2013.01); *F04C 18/16* (2013.01); *F04C 18/52* (2013.01); *F04C 28/12* (2013.01); *F04C 2270/17* (2013.01)

(58) Field of Classification Search

CPC ..... F04C 18/16; F04C 18/084; F04C 18/48; F04C 18/50; F04C 18/52; F04C 18/54; F04C 18/107; F04C 28/10; F04C 28/12; F04C 28/125; F04C 29/126

USPC ..... 418/194–197, 201.1, 201.2, 220; 417/310; 251/62, 318

See application file for complete search history.

(56) References Cited

U.S. PATENT DOCUMENTS 3,314,597 A * 4/1967 Schibbye ..... 418/159
3,432,089 A * 3/1969 Schibbye ..... 418/88

(Continued)

FOREIGN PATENT DOCUMENTS

DE 10326466 A1 * 1/2005 ..... F04C 29/10
JP 2004-137934 A 5/2004

OTHER PUBLICATIONS

International Search Report of corresponding EP Application No. PCT/JP2011/005516.

(Continued)

*Primary Examiner* — Thomas Denion
*Assistant Examiner* — Laert Dounis
(74) *Attorney, Agent, or Firm* — Global IP Counselors

(57) ABSTRACT

A screw compressor includes a casing having low and high pressure spaces, a screw rotor inserted in a cylinder part of the casing, and a slide valve disclosed in the cylinder part. The screw rotor has a plurality of helical grooves forming a compression chamber. The slide valve is moveable along an axis of the screw rotor and faces an outer periphery of the screw rotor to form a discharge port to communicating the compression chamber with the high pressure space. Fluid in the low pressure space is sucked into the compression chamber, compressed, and then discharged to the high-pressure space when the screw rotor rotates. The slide valve includes a sealing projection located on a back surface of the slide valve opposite to the screw rotor, and separating the low and high pressure spaces from each other when the sealing projection is in slidable contact with the casing.

6 Claims, 18 Drawing Sheets

(56) References Cited

U.S. PATENT DOCUMENTS

| | | | | |
|---|---|---|---|---|
| 3,936,239 | A * | 2/1976 | Shaw | 417/315 |
| RE29,283 | E * | 6/1977 | Shaw | 417/282 |
| 4,222,716 | A * | 9/1980 | Shaw | 417/310 |
| 4,536,130 | A * | 8/1985 | Orlando et al. | 417/63 |
| 2006/0039805 | A1 | 2/2006 | Gotou et al. | |

OTHER PUBLICATIONS

International Preliminary Report on Patentability and an English translation of Written Opinion of the International Searching Authority of corresponding international application No. PCT/JP2011/005516.

* cited by examiner

SCREW COMPRESSOR WITH SLIDE VALVE INCLUDING A SEALING PROJECTION

CROSS-REFERENCE TO RELATED APPLICATIONS

This U.S. National stage application claims priority under 35 U.S.C. §119(a) to Japanese Patent Application No. 2010-222170, filed in Japan on Sep. 30, 2010, the entire contents of which are hereby incorporated herein by reference.

TECHNICAL FIELD

The present disclosure relates to screw compressors capable of changing compression ratios thereof using slide valves.

BACKGROUND ART

Screw compressors have been conventionally widely used for applications of compressing a refrigerant or air. As described in Japanese Patent Publication No. 2004-137934, for example, a screw compressor capable of changing its compression ratio using a slide valve is also known.

Specifically, Japanese Patent Publication No. 2004-137934 shows a single-screw compressor including one screw rotor. This single-screw compressor includes a slide valve movable along the axis of the screw rotor. This slide valve has a discharge port. In the single-screw compressor, rotation of the screw rotor causes a fluid to be sucked in a compression chamber formed by a helical groove on the screw rotor and compressed. When the compression chamber comes to communicate with the discharge port of the slide valve, the compressed fluid is discharged from the compression chamber through the discharge port.

In the single-screw compressor of Japanese Patent Publication No. 2004-137934, when the slide valve moves, the discharge port thereof also moves. A change in the position of the discharge port changes the volume of the compression chamber at the time when the compression chamber starts communicating with the discharge port. Thus, movement of the slide valve changes the compression ratio accordingly.

A configuration of a conventional single-screw compressor will be described with reference to FIGS. 23-25.

As illustrated in FIG. 23, in the single-screw compressor, a screw rotor (520) is inserted in a cylinder part (511) in a casing (510). The screw rotor (520) is coupled to an electric motor, not shown, through a driving shaft (525). Helical groove (521) on the screw rotor (520) form a compression chamber. The helical grooves (521) are engaged with gates of a gate rotor. Rotation of the screw rotor (520) causes a fluid to be sucked from a low-pressure space (515) into the compression chamber, and compressed.

A slide valve (530) is disposed at the side of the screw rotor (520). As illustrated in FIG. 25, the slide valve (530) includes a valve body (531), a guide (534), and a joint (535). The valve body (531) has a columnar shape. The front surface (532) of the valve body (531) is curved and faces the outer periphery of the screw rotor (520). The back surface (533) of the valve body (531) is a cylindrical surface having a radius of curvature smaller than that of the front surface (532). The front surface of the guide (534) is in slidable contact with the outer peripheral surface of the bearing holder (512) fixed to the casing (510). The joint (535) is formed in a rod shape, and couples the valve body (531) and the guide (534) together. In the slide valve (530), space between the valve body (531) and the guide (534) serves as a discharge port (536). The fluid compressed in the compression chamber is discharged to a high-pressure space (516) through the discharge port (536).

A sealing projection (513) is formed on a portion of the casing (510) facing the back surface (533) of the valve body (531). A projection end surface (514) of the sealing projection (513) is curved to have a radius of curvature substantially equal to that of the back surface (533) of the valve body, and is in slidable contact with the back surface (533) of the valve body (531). The projection end surface (514) of the sealing projection (513) separates the low-pressure space (515) and the high-pressure space (516) from each other when the front end surface (514) is in slidable contact with the back surface (533) of the valve body (531).

SUMMARY

Technical Problem

The fluid pressure in the casing (510) is applied on the back surface (533) of the valve body (531) of the slide valve (530). Specifically, in the state illustrated in FIG. 23 (i.e., a state showing the highest compression ratio), on the back surface (533) of the valve body (531), the fluid pressure in the high-pressure space (516) is applied on a region (a region indicated as $A_H$ in FIG. 23) extending from the projection end surface (514) of the sealing projection (513) to the high-pressure space (516), and the fluid pressure in the low-pressure space (515) is applied on a region (a region indicated as $A_L$ in FIG. 23) extending from the projection end surface (514) of the sealing projection (513) toward the low-pressure space (515). On the other hand, in the state illustrated in FIG. 24 (i.e., a state showing the lowest compression ratio), on the back surface (533) of the valve body (531), the region extending from the projection end surface (514) of the sealing projection (513) toward the high-pressure space (516) is not present, and the fluid pressure in the low-pressure space (515) is applied on a region (a region indicated by $A_L$ in FIG. 24) extending from the projection end surface (514) of the sealing projection (513) toward the low-pressure space (515).

In this manner, in the conventional screw compressor, the area of a region on the back surface (533) of the valve body (531) on which the fluid pressure in the low-pressure space (515) is applied and the area of a region on the back surface (533) of the valve body (531) on which the fluid pressure in the high-pressure space (516) is applied, changes depending on the position of the slide valve (530). Accordingly, in the conventional screw compressor, a force that pushes the slide valve (530) toward the screw rotor (520) varies depending on the position of the slide valve (530), and a clearance between the front surface (532) of the valve body (531) and the screw rotor (520) changes depending on the position of the slide valve (530). On the other hand, even in a state in which the slide valve (530) is closest to the screw rotor (520), it is necessary to prevent contact of the slide valve (530) with the screw rotor (520). Thus, at some positions of the slide valve (530), the clearance between the slide valve (530) and the screw rotor (520) might be excessively enlarged to increase the amount of a fluid leaking from the compression chamber, causing a decrease in operation efficiency of the screw compressor.

It is therefore an object of the present disclosure to enhance the operation efficiency of a screw compressor by reducing the amount of a refrigerant leaking from a compression chamber through a clearance between a slide valve and a screw rotor.

Solution to the Problem

In a first aspect of the present disclosure, a screw compressor includes: a casing (10) in which a low-pressure space (S1)

and a high-pressure space (S2) are formed; a screw rotor (40) on which a plurality of helical grooves (41) forming a compression chamber (23) are provided, and which is configured to be inserted in a cylinder part (30) of the casing (10); and a slide valve (60) provided in the cylinder part (30) to be moveable along an axis of the screw rotor (40), and facing an outer periphery of the screw rotor (40) to form a discharge port (25) through which the compression chamber (23) communicates with the high-pressure space (S2), wherein when the screw rotor (40) rotates, a fluid in the low-pressure space (S1) is sucked in the compression chamber (23), compressed, and then discharged to the high-pressure space (S2), and the slide valve (60) includes a sealing projection (66) that is located on a back surface of the slide valve (60) opposite to the screw rotor (40) and that separates the low-pressure space (S1) and the high-pressure space (S2) from each other when the sealing projection (66) is in slidable contact with the casing (10).

In the screw compressor (1) of the first aspect, the screw rotor (40) is inserted in the cylinder part (30) of the casing (10), and the helical grooves (41) on the helical grooves (41) form the compression chamber (23). Rotation of the screw rotor (40) causes a fluid in the low-pressure space (S1) to be sucked in the compression chamber (23). Once the compression chamber (23) is separated from the low-pressure space (S1), the volume of the compression chamber (23) gradually decreases, and a fluid in the compression chamber (23) is compressed. When the compression chamber (23) communicates with the discharge port (25), the fluid compressed in the compression chamber (23) is discharged to the high-pressure space (S2) through the discharge port (25).

In the first aspect, the slide valve (60) is provided in the cylinder part (30) of the casing (10). The slide valve (60) is moveable along the axis of the screw rotor (40). When the slide valve (60) moves, the discharge port (25) formed by the slide valve (60) also moves. The movement of the discharge port (25) changes the volume of the compression chamber (23) immediately before the compression chamber (23) communicates with the discharge port (25). The compression ratio R is a value obtained by dividing the volume $V_1$ of the compression chamber (23) immediately after end of a suction stroke by the volume $V_2$ of the compression chamber (23) immediately before start of a discharge stroke (i.e., $R=V_1/V_2$). That is, the compression ratio R is equivalent to the internal volume ratio.

The slide valve (60) of the first aspect includes the sealing projection (66). The sealing projection (66) projects from the back surface of the slide valve (60), and is configured to be in slidable contact with the casing (10). In the casing (10), leakage of a fluid from the high-pressure space (S2) to the low-pressure space (S1) is reduced when the sealing projection (66) of the slide valve (60) is in slidable contact with the casing (10). That is, the sealing projection (66) separates the low-pressure space (S1) and the high-pressure space (S2) from each other when being in slidable contact with the casing (10).

On the back surface of the slide valve (60) of the first aspect, the pressure of a fluid in the low-pressure space (S1) is applied on a region extending from the sealing projection (66) toward the low-pressure space (S1), and the pressure of a fluid in the high-pressure space (S2) is applied on a region extending from the sealing projection (66) toward the high-pressure space (S2). On the other hand, since the sealing projection (66) is provided on the slide valve (60), movement of the slide valve (60) changes the position of the sealing projection (66). Accordingly, on the back surface of the slide valve (60), "the area of a region on which the fluid pressure in the low-pressure space (S1) is applied" and "the area of a region on which the fluid pressure in the high-pressure space (S2) is applied" are constant even when the slide valve (60) moves. Thus, as long as the fluid pressure in the low-pressure space (S1) and the fluid pressure in the high-pressure space (S2) are constant, a force that is applied from the fluids in the low-pressure space (S1) and the high-pressure space (S2) to the slide valve (60) are also constant, independently of the position of the slide valve (60).

In a second aspect of the present disclosure, in the screw compressor of the first aspect, a portion of the slide valve (60) extending from the discharge port (25) toward the low-pressure space (S1) serves as a valve body (65), the valve body (65) has a front end facing the low-pressure space (S1) and a rear end facing the discharge port (25), and the sealing projection (66) extends along the rear end of the valve body (65).

In the slide valve (60) of the second aspect, the valve body (65) includes the sealing projection (66). The sealing projection (66) projects from the back surface of the slide valve (60), and extends along the rear end (i.e., an end facing the discharge port (25)) of the valve body (65). Thus, on the back surface of the valve body (65) of this aspect, the region extending from the sealing projection (66) to the discharge port (25), is not present.

In the casing (10) of the second aspect, the sealing projection (66) of the valve body (65) separates the low-pressure space (S1) and the high-pressure space (S2) from each other when being in slidable contact with the casing (10). Accordingly, the fluid pressure applied on a region of the back surface of the valve body (65) extending from the sealing projection (66) toward the low-pressure space (S1), is lower than the fluid pressure in the high-pressure space (S2). On the other hand, as described above, in the valve body (65) of this aspect, the region extending from the sealing projection (66) to the discharge port (25) toward the high-pressure space (S2)), is not present on the back surface of the valve body (65). Thus, on the back surface of the valve body (65) of this aspect, there are substantially no regions on which the fluid pressure in the high-pressure space (S2) is applied.

In a third aspect of the present disclosure, in the screw compressor of the second aspect, a thickness of the valve body (65) increases from the front end of the valve body (65) to the sealing projection (66).

In the third aspect, the thickness of the valve body (65) increases with decreasing distance to the rear end of the valve body (65). Accordingly, the rigidity of the valve body (65) increases with decreasing distance to the rear end of the valve body (65).

In a fourth aspect of the present disclosure, in the screw compressor of the second or third aspect, in a portion of the valve body (65) extending from the sealing projection (66) to the front end, the valve body (65) includes a supporting projection (67) that is located on a back surface of the valve body (65) and is configured to be in slidable contact with the casing (10).

The valve body (65) of the fourth aspect includes the supporting projection (67) in addition to the sealing projection (66). The supporting projection (67) projects from the back surface of the valve body (65), and is configured to be in slidable contact with the casing (10). Since the valve body (65) faces the screw rotor (40), a fluid that is being compressed in the compression chamber (23) is applied on the front surface of the valve body (65). Thus, a force that pulls the valve body (65) away from the screw rotor (40) (i.e., pushes the valve body (65) toward the back surface of the valve body (65)) acts on the valve body (65). The valve body (65) subjected to this force is supported by the sealing projection (66) and the supporting projection (67) that are substantially in contact with the casing (10).

In a fifth aspect of the present disclosure, in the screw compressor of the fourth aspect, the supporting projection (67) extends along the front end of the valve body (65).

In the valve body (65) of the fifth aspect, the supporting projection (67) extends along the front end opposite to the rear end along which the sealing projection (66) extends. The valve body (65) on which the fluid pressure in the compression chamber (23) is applied, is supported by the sealing projection (66) extending along the rear end of the valve body (65) and the supporting projection (67) extending along the front end of the valve body (65), where the sealing projection (66) and the supporting projection (67) are in contact with the casing (10).

In a sixth aspect of the present disclosure, in the screw compressor of the fifth aspect, the valve body (65) includes a communication passage (68, 69) through which space sandwiched between the sealing projection (66) and the supporting projection (67) communicates with the low-pressure space (S1).

In the sixth aspect, the valve body (65) includes the communication passage (68, 69), and space sandwiched between the sealing projection (66) and the supporting projection (67) communicates with the low-pressure space (S1) through the communication passage (68, 69). Thus, the internal pressure of the space sandwiched between the sealing projection (66) and the supporting projection (67) is substantially equal to the fluid pressure in the low-pressure space (S1).

In a seventh aspect of the present disclosure, in the screw compressor of the fourth aspect, the supporting projection (67) extends from the sealing projection (66) to the front end of the valve body (65).

The supporting projection (67) of the seventh aspect extends across the overall length of a portion of the valve body (65) extending from the sealing projection (66) to the front end. The valve body (65) on which the fluid pressure in the compression chamber (23) is applied, is supported by the sealing projection (66) extending along the rear end of the valve body (65) and the supporting projection (67) extending across the overall length of a portion of the valve body (65) extending from the sealing projection (66) to the front end, where the sealing projection (66) and the supporting projection (67) are in contact with the casing (10).

In an eighth aspect of the present disclosure, in the screw compressor of the seventh aspect, a width of the supporting projection (67) gradually increases from the front end of the valve body (65) to the sealing projection (66).

In the eighth aspect, the width of the supporting projection (67) extending from the front end of the valve body (65) to the sealing projection (66) gradually increases from the front end of the valve body (65) to the sealing projection (66). The supporting projection (67) is a portion of the valve body (65) projecting from the back surface of the valve body (65). Thus, as the width of the supporting projection (67) increases, the rigidity of the valve body (65) increases. Consequently, the rigidity of the valve body (65) of this aspect increases with decreasing distance to the rear end of the valve body (65).

In a ninth aspect of the present disclosure, in the screw compressor of the eighth aspect, only a part, in a width direction, of a projection end surface of the supporting projection (67) serves as a supporting slidable-contact surface (78) configured to be in slidable contact with the casing (10).

In the ninth aspect, not the entire part but a part of the supporting projection (67) in the width direction thereof serves as the supporting slidable-contact surface (78). Only part of the projection end surface of the supporting projection (67) constituting the supporting slidable-contact surface (78) is in slidable contact with the casing (10), and the other part is not in slidable contact with the casing (10).

Advantages of the Invention

In an aspect of the present disclosure, the sealing projection (66) on the slide valve (60) separates the low-pressure space (S1) and the high-pressure space (S2) in the casing (10) from each other when the sealing projection (66) is in slidable contact with the casing (10). Thus, "the area of a region on which the pressure of a fluid in the low-pressure space (S1) is applied" and "the area of a region on which the pressure of a fluid in the high-pressure space (S2) is applied" are constant even when the slide valve (60) moves. As a result, a force that is applied from the fluids in the low-pressure space (S1) and the high-pressure space (S2) to the slide valve (60) are also constant, independently of the position of the slide valve (60).

The force that is applied from the fluids in the low-pressure space (S1) and the high-pressure space (S2) to the slide valve (60) pushes the slide valve (60) toward the screw rotor (40). When this force changes, the amount of movement of the slide valve (60) toward the screw rotor (40) changes, resulting in the possibility of a change of a clearance between the slide valve (60) and the screw rotor (40).

On the other hand, in this aspect, a force that is applied from the fluids in the low-pressure space (S1) and the high-pressure space (S2) to the slide valve (60) are constant, independently of the position of the slide valve (60). Accordingly, even when the slide valve (60) is moved in order to change the compression ratio, the slide valve (60) does not approach the screw rotor (40).

Thus, in this aspect, it is possible to reduce the clearance between the slide valve (60) and the screw rotor (40) as compared to conventional compressors, while preventing the slide valve (60) from being in contact with the screw rotor (40). As a result, the amount of leakage of a fluid from the compression chamber (23) can be reduced, thereby enhancing the operation efficiency of the screw compressor (1).

In the second aspect, the sealing projection (66) extends along the rear end (i.e., an end toward the discharge port (25)) of the valve body (65), and separates the low-pressure space (S1) and the high-pressure space (S2) from each other when being in slidable contact with the casing (10). Thus, on the back surface of the valve body (65), the fluid pressure applied on a region extending from the sealing projection (66) toward the low-pressure space (S1) is lower than the fluid pressure in the high-pressure space (S2). On the back surface of the valve body (65), a region on which the fluid pressure in the high-pressure space (S2) is applied is not substantially present.

Accordingly, in the second aspect, a force that pushes the slide valve (60) toward the screw rotor (40) can be reduced. Thus, it is possible to reduce the clearance between the slide valve (60) and the screw rotor (40) to reduce the amount of leakage of a refrigerant from the compression chamber (23), while preventing the slide valve (60) from being in contact with the screw rotor (40).

The slide valve (60) faces the outer periphery of the screw rotor (40). Accordingly, the fluid pressure in the compression chamber (23) formed by the helical grooves (41) of the screw rotor (40) is applied on the valve body (65). On the other hand, the fluid pressure in the compression chamber (23) gradually increases as the compression chamber (23) approaches the discharge port (25). Thus, a higher fluid pressure in the compression chamber (23) is applied on the valve body (65) as the distance to the rear end close to the discharge port (25) decreases.

In the third aspect, the rigidity of the valve body (65) increases with decreasing distance to the rear end of the valve body (65). Specifically, in the valve body (65) of this aspect, the rigidity increases with decreasing distance to the rear end on which a high fluid pressure in the compression chamber (23) is applied, and thus, the degree of deformation of a portion near the rear end can be reduced. Consequently, the degree of deformation of the valve body (65) due to the fluid pressure in the compression chamber (23) can be uniformized in the entire valve body (65). Accordingly, in this aspect, the clearance between the front surface of the valve body (65) and the screw rotor (40) can be uniformized in the entire valve body (65). As a result, the amount of leakage of a fluid from the compression chamber (23) can be further reduced, thereby further enhancing the operation efficiency of the screw compressor (1).

In the fourth aspect, the valve body (65) of the slide valve (60) includes both of the sealing projection (66) and the supporting projection (67). Since the pressure of a fluid that is being compressed in the compression chamber (23) is applied on the front surface of the valve body (65), the valve body (65) is pushed toward the back surface. On the other hand, in these aspects, the valve body (65) pushed toward the back surface by the fluid in the compression chamber (23) is supported by the sealing projection (66) and the supporting projection (67) both of which are in slidable contact with the casing (10).

Accordingly, in the fourth aspect, deformation of the valve body (65) due to the pressure of the fluid in the compression chamber (23) can be reduced. As a result, enlargement of the clearance between the valve body (65) and the screw rotor (40) due to deformation of the valve body (65) can be reduced, thereby maintaining a high operation efficiency of the screw compressor (1).

In the valve body (65) of the fifth and sixth aspects, the supporting projection (67) extends along the front end of the valve body (65) farthest from the sealing projection (66). The valve body (65) on which the pressure of the fluid in the compression chamber (23) is applied is supported by the sealing projection (66) and the supporting projection (67) both of which are in contact with the casing (10). Accordingly, in these aspects, the degree of deformation of the valve body (65) can be reduced, and thus, the clearance between the front surface of the valve body (65) and the screw rotor (40) can be uniformized in the entire valve body (65).

In particular, in the sixth aspect, space sandwiched between the sealing projection (66) and the supporting projection (67) communicates with the low-pressure space (S1) through the communication passage (68, 69). Thus, the internal pressure of the space sandwiched between the sealing projection (66) and the supporting projection (67) is substantially equal to the pressure of the fluid in the pressure of the fluid in the low-pressure space (S1). That is, on the back surface of the valve body (65), the fluid pressure applied on a region between the sealing projection (66) and the supporting projection (67) is substantially equal to the fluid pressure in the low-pressure space (S1). Thus, in this aspect, a force that pushes the valve body (65) toward the screw rotor (40) can be reduced. As a result, it is possible to reduce the clearance between the slide valve (60) and the screw rotor (40) to further reduce the amount of leakage of the refrigerant from the compression chamber (23), while ensuring prevention of contact between the slide valve (60) and the screw rotor (40).

In the valve body (65) of the seventh aspect, the supporting projection (67) extends across the overall length of a portion of the valve body (65) extending from the sealing projection (66) to the front end. The valve body (65) to which the fluid pressure in the compression chamber (23) is applied is supported by the sealing projection (66) and the supporting projection (67) both of which are in contact with the casing (10). Thus, in this aspect, the degree of deformation of the valve body (65) can be reduced, thereby uniformizing the clearance between the front surface of the valve body (65) and the screw rotor (40) in the entire valve body (65).

In the valve body (65) of the eighth aspect, the width of the supporting projection (67) on the back surface of the valve body (65) gradually increases from the front end to the rear end of the valve body (65). Accordingly, the rigidity of the valve body (65) increases with decreasing distance to the rear end of the valve body (65). On the other hand, as described above, a higher fluid pressure in the compression chamber (23) is applied on the valve body (65) as the distance to the rear end close to the discharge port (25) decreases. Accordingly, the rigidity of the valve body (65) increases with decreasing distance to the rear end of the valve body (65). As a result, a portion of the valve body (65) near the rear end on which a high fluid pressure in the compression chamber (23) is applied has a high rigidity, and thus, the degree of deformation due to the fluid pressure in the compression chamber (23) can be uniformized in the entire valve body (65).

Accordingly, in the eighth aspect, the clearance between the front surface of the valve body (65) and the screw rotor (40) can be uniformized in the entire valve body (65). As a result, the amount of leakage of a refrigerant from the compression chamber (23) can be further reduced, thereby further enhancing the operation efficiency of the screw compressor (1).

In the ninth aspect, part of the projection end surface of the supporting projection (67) except the supporting slidable-contact surface (78) is not in slidable contact with the casing (10). The fluid pressure applied on the part of the projection end surface of the supporting projection (67) except the supporting slidable-contact surface (78) is substantially equal to the fluid pressure in the low-pressure space (S1). Thus, even in a case where the width of the supporting projection (67) is increased in order to reduce the degree of deformation of the degree of deformation of the valve body (65), the area of a region on which the fluid pressure in the low-pressure space (S1) is applied can be ensured on the back surface of the slide valve (60). As a result, in this aspect, an increase in the width of the supporting projection (67) can reduce a force that pushes the slide valve (60) toward the screw rotor (40), while reducing the degree of deformation of the valve body (65).

BRIEF DESCRIPTION OF THE DRAWINGS

FIG. 8(A) shows a suction stroke, FIG. 8(B) shows a compression stroke, and FIG. 8(C) shows a discharge stroke.

DESCRIPTION OF EMBODIMENTS

Embodiments of the present disclosure will be described hereinafter with reference to the drawings. The following embodiments are merely preferred examples in nature, and are not intended to limit the scope, applications, and use of the invention.

First Embodiment

A single-screw compressor (1) (hereinafter referred to as a "screw compressor") according to a first embodiment is provided in a refrigerant circuit for performing a refrigeration cycle, and used to compress a refrigerant.

<Schematic Configuration of Screw Compressor>

Figure 1:
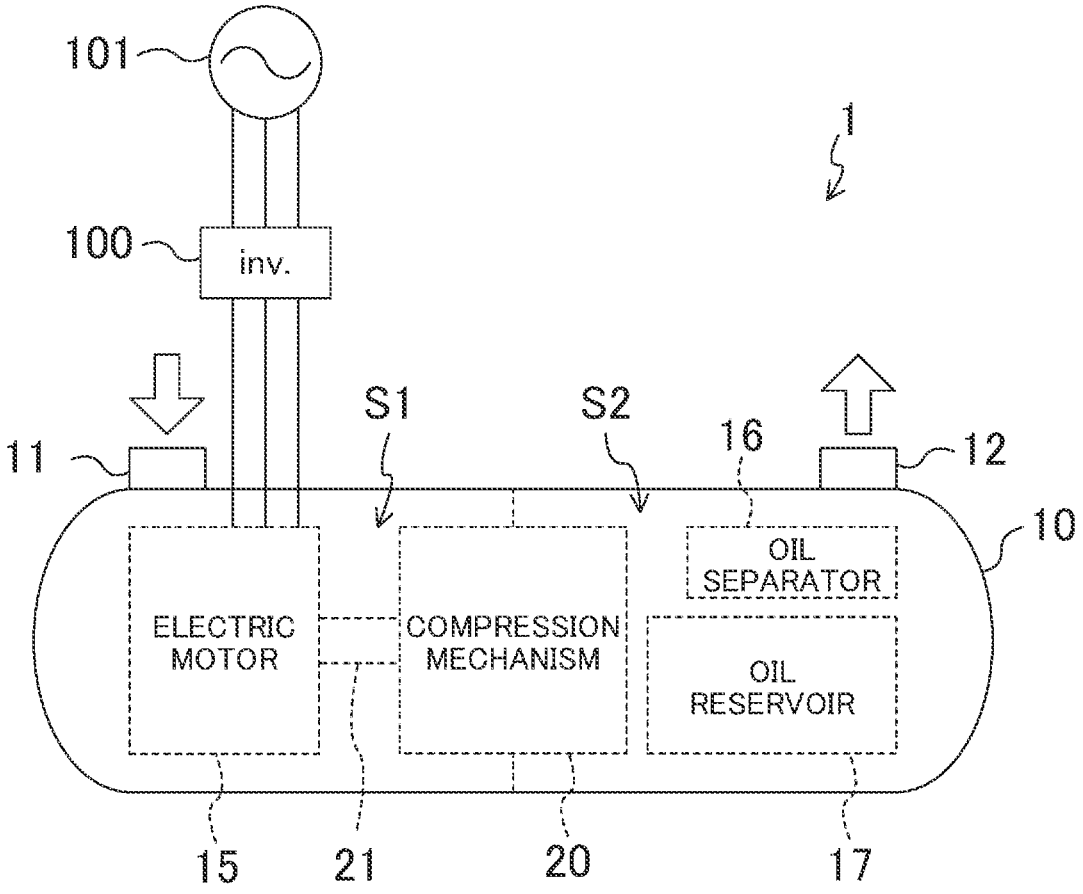
FIG. 1 is a view schematically illustrating a configuration of a single-screw compressor according to a first embodiment.

As illustrated in FIG. 1, in the screw compressor (1), a compression mechanism (20) and an electric motor (15) for driving the compression mechanism (20) are housed in a casing (10). This screw compressor (1) is semi-hermetic.

The casing (10) is in the shape of a horizontally-oriented cylinder. In the casing (10), a low-pressure space (S1) located at an end of the casing (10) and a high-pressure space (S2) located at the other end of the casing (10) are formed. The casing (10) includes a suction pipe connection part (11) communicating with the low-pressure space (S1) and a discharge pipe connection part (12) communicating with the high-pressure space (S2). A low-pressure gas refrigerant (i.e., a low-pressure fluid) having flown from an evaporator in the refrigerant circuit flows into the low-pressure space (S1) through the suction pipe connection part (11). A compressed high-pressure gas refrigerant discharged from the compression mechanism (20) to the high-pressure space (S2) is supplied to a condenser in the refrigerant circuit through the discharge pipe connection part (12).

In the casing (10), the electric motor (15) is located in the low-pressure space (S1), and the compression mechanism (20) is located between the low-pressure space (S1) and the high-pressure space (S2). A driving shaft (21) of the compression mechanism (20) is coupled to the electric motor (15). In the casing (10), an oil separator (16) is provided in the high-pressure space (S2). The oil separator (16) separates refrigerating machine oil from the refrigerant discharged from the compression mechanism (20). An oil reservoir (17) for storing refrigerating machine oil as lubricating oil is formed below the oil separator (16) in the high-pressure space (S2). The refrigerating machine oil separated from the refrigerant in the oil separator (16) is dropped to be stored in the oil reservoir (17).

The screw compressor (1) of this embodiment includes an inverter (100). The inverter (100) has its input side connected to a commercial power supply (101) and its output side connected to the electric motor (15). The inverter (100) adjusts the frequency of an alternating current input from the commercial power supply (101), and supplies an alternating current converted to have a predetermined frequency to the electric motor (15).

When the output frequency of the inverter (100) is changed, the rotation speed of the electric motor (15) changes, and the rotation speed of a screw rotor (40) driven by the electric motor (15) also changes. The change in the rotation speed of the screw rotor (40) causes a change in the mass flow rate of a refrigerant that is sucked in the screw compressor (1) and discharged after being compressed. That is, the change in the rotation speed of the screw rotor (40) causes a change in operation capacity of the screw compressor (1).

<Detailed Configuration of Screw Compressor>

Figure 2:
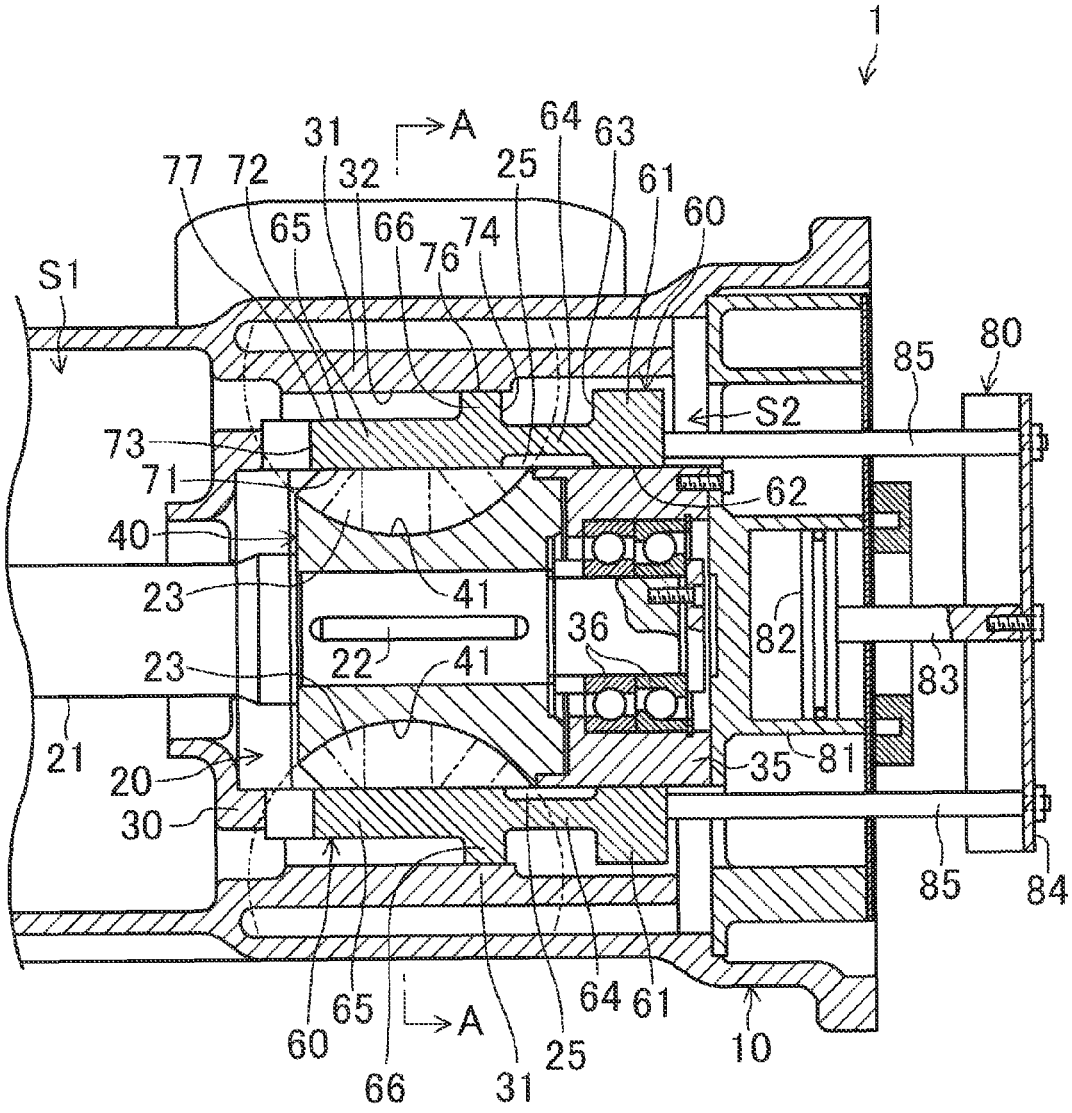
FIG. 2 is a cross-sectional view illustrating a main portion of the single-screw compressor of the first embodiment, and shows a state with the highest compression ratio.
Figure 4:
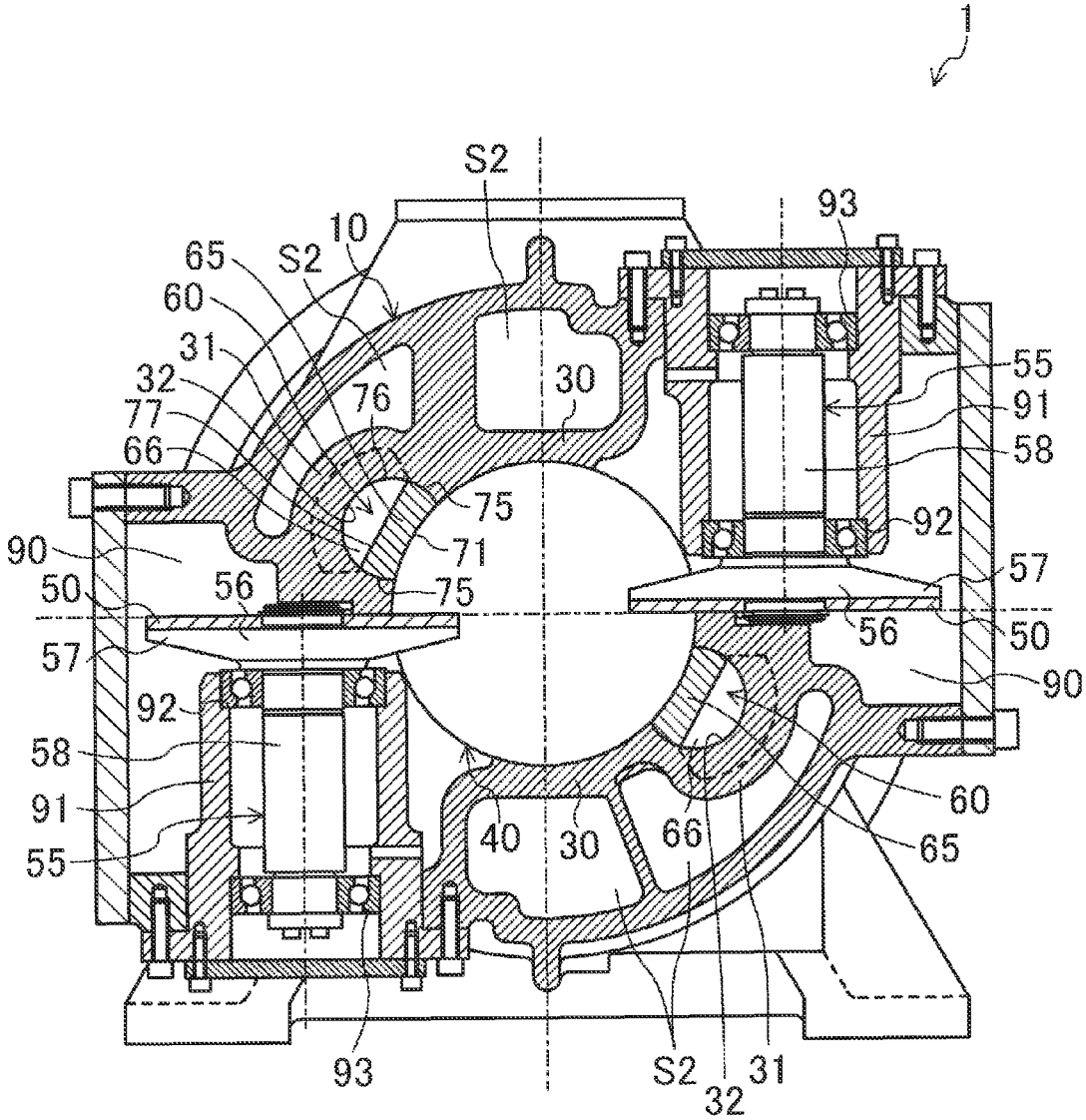
FIG. 4 is a cross-sectional view taken along line A-A in FIG. 2.

As illustrated in FIGS. 2 and 4, the compression mechanism (20) includes a cylindrical cylinder part (30) formed in the casing (10), the screw rotor (40) located in the cylinder part (30), and two gate rotors (50) engaged with the screw rotor (40). The screw compressor (1) includes a slide valve (60) for changing the compression ratio.

The driving shaft (21) is inserted in the screw rotor (40). The driving shaft (21) and the screw rotor (40) are coupled together by a key (22). The driving shaft (21) is located on the same axis as the screw rotor (40).

A bearing holder (35) is inserted in an end of the cylinder part (30) facing the high-pressure space (S2). The bearing holder (35) has a relatively thick approximately cylindrical shape. The outside diameter of the bearing holder (35) is substantially equal to the diameter of the inner peripheral surface (i.e., a surface in slidable contact with the outer peripheral surface of the screw rotor (40)) of the cylinder part (30). A ball bearing (36) is provided in the bearing holder (35). A tip portion of the driving shaft (21) is inserted in the ball bearing (36) such that the ball bearing (36) rotatably supports the driving shaft (21).

Figure 5:
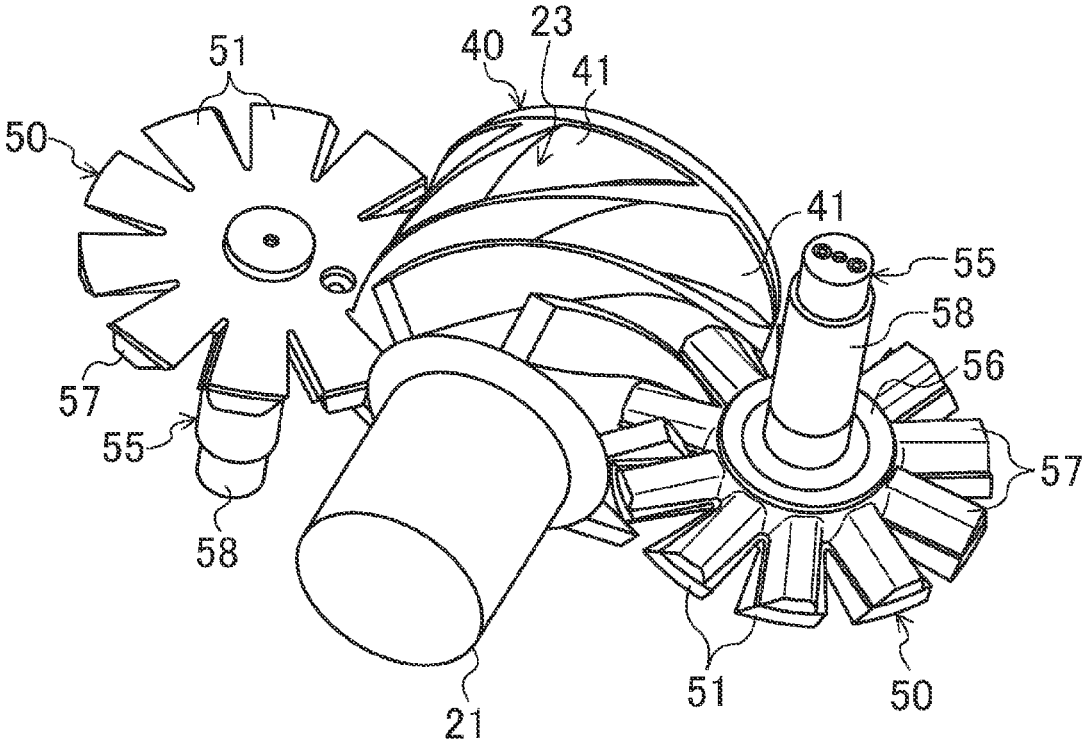
FIG. 5 is a perspective view illustrating only a main portion of the single-screw compressor.

As illustrated in FIG. 5, the screw rotor (40) is a metal member having an approximately cylindrical columnar shape. The screw rotor (40) is rotatably fitted in the cylinder part (30), and the outer peripheral surface of the screw rotor (40) is in slidable contact with the inner peripheral surface of the cylinder part (30). A plurality of (six in this embodiment) of helical grooves (41) are formed on the outer periphery of the screw rotor (40) to helically extend from one end to the other of the screw rotor (40).

Each of the helical grooves (41) on the screw rotor (40) has a start end at a proximal end in FIG. 5, and a terminal end at a distal end in FIG. 5. The proximal end (an end at the suction side), in FIG. 5, of the screw rotor (40) is tapered. In the screw rotor (40) illustrated in FIG. 5, the start ends of the helical grooves (41) are open at the tapered proximal end surfaces, and the terminal ends of the helical grooves (41) are not open at the distal end surfaces.

The gate rotors (50) are resin members. In each of the gate rotors (50) includes a plurality of (11 in this embodiment) gates (51) which are radially arranged and each of which is in the shape of a rectangular plate. The gate rotors (50) are located outside the cylinder part (30) and disposed to be symmetric with respect to the rotation axis of the screw rotor (40). The axial center of each of the gate rotors (50) is orthogonal to the axial center of the screw rotor (40). Each of the gate rotors (50) is engaged with the helical grooves (41) on the screw rotor (40) with the gates (51) penetrating part of the cylinder part (30).

Each of the gate rotors (50) is attached to a metal rotor supporter (55) (see FIG. 5). The rotor supporter (55) includes a base part (56), arm parts (57), and a shaft part (58). The base part (56) is in the shape of a relatively thick disc. The number of the arm parts (57) is equal to that of the gates (51) of an associated one of the gate rotors (50), and the arm parts (57) radially outwardly extend from the outer peripheral surface of the base part (56). The shaft part (58) has a rod shape, and is formed so as to stand on the base part (56). The central axis of the shaft part (58) coincides with the central axis of the base part (56). Each of the gate rotors (50) is attached to the surfaces of the base part (56) and the arm parts (57) opposite to the shaft part (58). The arm parts (57) are in contact with the back surfaces of the gates (51).

The rotor supporters (55) to which the gate rotors (50) are attached are housed in gate rotor chambers (90) adjacent to the cylinder part (30) and defined in the casing (10) (see FIG. 4). The shaft (58) of each of the rotor supporters (55) is rotatably supported on the bearing housing (91) in the gate rotor chamber (90) with a ball bearing (92, 93) interposed therebetween. Each of the gate rotor chambers (90) communicates with the low-pressure space (S1).

In the compression mechanism (20), space formed by the inner peripheral surface of the cylinder part (30), the helical grooves (41) on the screw rotor (40), and the gates (51) of the gate rotors (50) serves as a compression chamber (23). The helical grooves (41) on the screw rotor (40) are open to the low-pressure space (S1) at the suction-side ends of the helical grooves (41).

Figure 7:
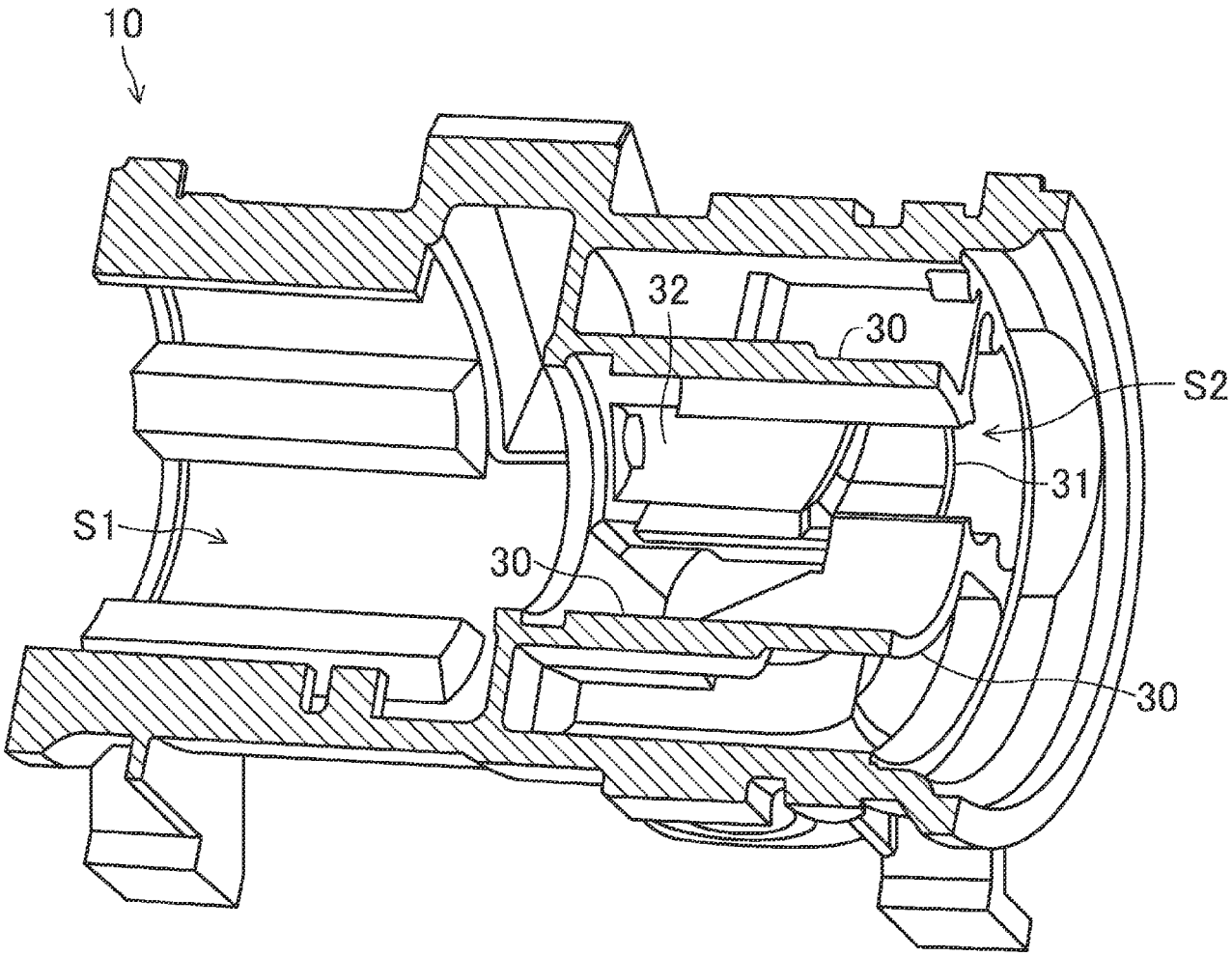
FIG. 7 is a perspective view illustrating a vertical cross section of casing of the single-screw compressor of the first embodiment.

As also illustrated in FIG. 7, slide valve housings (31) in each of which the slide valve (60) is placed are formed in the cylinder part (30) of the casing (10). The slide valve housings (31) are disposed at two locations along the periphery of the cylinder part (30). Each of the slide valve housings (31) has a concave groove shape that is open at the inner peripheral surface of the cylinder part (30) and extends along the axis of the cylinder part (30). The inner surface of the slide valve housing (31) is cylindrical, and serves as a slidable-contact curved surface (32) that is in slidable contact with the slide valve (60). An end of the slide valve housing (31) facing the low-pressure space (S1) communicates with the low-pressure space (S1), and the other end of the slide valve housings (31) facing the high-pressure space (S2) communicates with the high-pressure space (S2).

Figure 6:
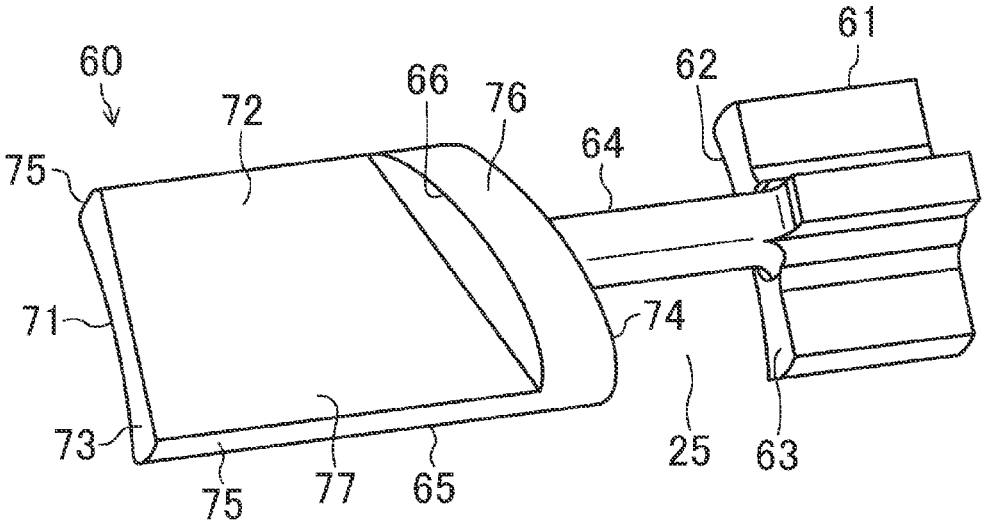
FIG. 6 is a perspective view illustrating a slide valve according to the first embodiment.

As illustrated in FIG. 6, the slide valve (60) includes: a valve body (65), which is the body of the valve; a guide (61); and a joint (64). This slide valve (60) is inserted in the slide valve housings (31) with the tip of the valve body (65) facing the low-pressure space (S1), and is slidable along the axis of the cylinder part (30) (see FIGS. 2 and 3).

The valve body (65) is in the shape of a generally thick plate. In this valve body (65), a front surface (71) facing the screw rotor (40) is a cylindrical surface having a radius of curvature substantially equal to that of the inner peripheral surface of the cylinder part (30) (see FIG. 4). On the other hand, part of a back surface (72) of the valve body (65) located at the side opposite to the screw rotor (40) is a cylindrical surface, and the other part of the back surface (72) is a flat surface. This structure will be described later. A front end surface (73) of the valve body (65) is a flat surface substantially orthogonal to the axis of the valve body (65), and a rear end surface (74) of the valve body (65) is a flat surface that is tilted with respect to the axis of the valve body (65). The rear end surface (74) of the valve body (65) is tilted along the helical grooves (41) of the screw rotor (40). Both side surfaces (75) of the valve body (65) are cylindrical surfaces each having a radius of curvature substantially equal to that of the inner peripheral surface of the slide valve housings (31) (see FIG. 4).

The valve body (65) has a sealing projection (66). The sealing projection (66) has an arc shape on the back surface of the valve body (65), and extends along the rear end of the valve body (65). That is, the sealing projection (66) projects from the back surface of the valve body (65). The convex surface of the sealing projection (66) is a cylindrical surface having a radius of curvature substantially equal to that of the slidable-contact curved surface (32) of the slide valve housing (31), and forms a slidable-contact surface (76) for sealing, which will be hereinafter referred to as a sealing slidable-contact surface (76), to be in slidable contact with the slidable-contact curved surface (32). A portion of the back surface of the valve body (65) extending from the sealing projection (66) to the front end thereof, forms a nonslidable-contact surface (77) that is a flat surface and is not in slidable contact with the slidable-contact curved surface (32). That is, in the back surface of the valve body (65), the sealing slidable-contact surface (76) that is the convex surface of the sealing projection (66) is a cylindrical surface, and the rest constituting the nonslidable-contact surface (77) is a flat surface.

A portion of the valve body (65) extending from the sealing projection (66) to the front end thereof has a constant thickness along the axis of the valve body (65). As described above, the front surface (71) of the valve body (65) is a cylindrical surface, and the nonslidable-contact surface (77) of the valve body (65) is a flat surface. Thus, the thickness of the portion of the valve body (65) extending from the sealing projection (66) to the front end thereof varies in the width direction of the valve body (65), but does not vary along the axis of the valve body (65).

The guide (61) is in the shape of a generally thick plate. A front surface (62) of the guide (61) facing the bearing holder (35) is a cylindrical surface having a radius of curvature substantially equal to that of the outer peripheral surface of the bearing holder (35), and is in slidable contact with the outer peripheral surface of the bearing holder (35) (see FIG. 2). In the guide (61), the front surface (62) is oriented to the same direction as the front surface (71) of the valve body (65), and a front end surface (63) is opposed to the rear end surface (74) of the valve body (65). On the back surface of the guide (61), a ridge-like projection is formed from the front end to the rear end.

The joint (64) is in the shape of a relatively short rod, and couples the valve body (65) and the guide (61) together. An end of the joint (64) is continuous to the rear end surface (74) of the valve body (65), and the other end of the joint (64) is continuous to the front end surface (63) of the guide (61). In the slide valve (60), space between the rear end surface (74) of the valve body (65) and the front end surface (73) of the guide (61) serves as a discharge port (25).

As described above, the slide valve (60) is inserted in the slide valve housing (31) (see FIG. 2). An end of the slide valve housing (31) facing the low-pressure space (S1) communicates with the low-pressure space (S1), and the other end of the slide valve housings (31) facing the high-pressure space (S2) communicates with the high-pressure space (S2). In a state in which the slide valve (60) is inserted in the slide valve housing (31), the sealing slidable-contact surface (76) as a convex surface of the sealing projection (66) on the valve body (65) is in slidable contact with the slidable-contact curved surface (32) constituted by the inner peripheral surface of the slide valve housing (31). The sealing projection (66) of the slide valve (60) separates the low-pressure space (S1) and the high-pressure space (S2) from each other when the sealing projection (66) is in slidable contact with the slidable-contact curved surface (32) of the slide valve housing (31).

The sealing slidable-contact surface (76) of the slide valve (60) does not need to come in physical contact with the slidable-contact curved surface (32) of the casing (10). In the compression mechanism (20) of this embodiment, an oil film is generally formed between the sealing slidable-contact surface (76) and the slidable-contact curved surface (32) to seal the clearance between the sealing slidable-contact surface (76) and the slidable-contact curved surface (32).

In a state in which the slide valve (60) is inserted in the slide valve housing (31), the discharge port (25) formed between the valve body (65) and the guide (61) faces the outer periphery of the screw rotor (40). The compression chamber (23) formed by the helical grooves (41) of the screw rotor (40) communicates with the high-pressure space (S2) through the discharge port (25).

As illustrated in FIG. 2, the screw compressor (1) includes a slide valve drive mechanism (80) for moving the slide valve (60). This slide valve drive mechanism (80) includes: a cylinder (81) fixed to the bearing holder (35); a piston (82) placed in the cylinder (81); an arm (84) coupled to a piston rod (83) of the piston (82); and coupling rods (85) coupling the arm (84) and the slide valve (60) together.

In the slide valve drive mechanism (80) illustrated in FIG. 2, the internal pressure of the left-hand space in the piston (82) is higher than the internal pressure of the right-hand space in the piston (82). The slide valve drive mechanism (80) is configured to adjust the position of the slide valve (60) by adjusting the internal pressure in the right-hand space (i.e., the gas pressure in the right-hand space) in the piston (82).

In operation of the screw compressor (1), in the slide valve (60), the refrigerant pressure in the low-pressure space (S1) is applied on the front end surface (73) of the valve body (65), and the refrigerant pressure in the high-pressure space (S2) is applied on the rear end surface (74) of the valve body (65). Accordingly, in operation of the screw compressor (1), a force that always pushes the slide valve (60) toward the low-pressure space (S1) is applied on the slide valve (60). Thus, a change in the internal pressures of the left-hand space and the right-hand space in the piston (82) of the slide valve drive mechanism (80) changes the degree of a force that pulls the slide valve (60) back to the high-pressure space (S2), resulting in a change in the position of the slide valve (60).

—Operation of Compressing Refrigerant by Screw Compressor—

Figure 8:
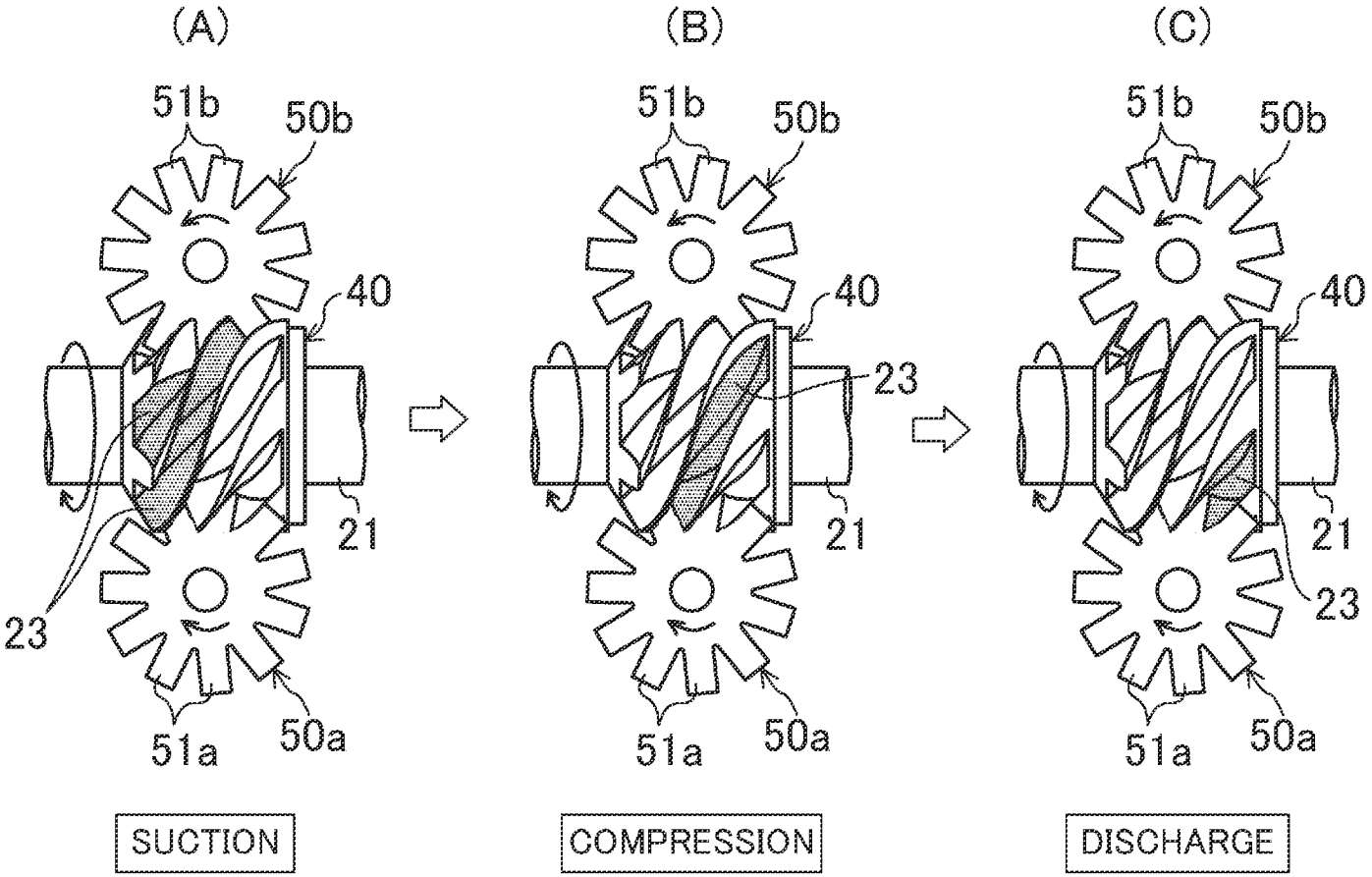
FIGS. 8(A)-8(C) are plan views illustrating operation of a compression mechanism of the single-screw compressor.

Operation in which the screw compressor (1) compresses a refrigerant will now be described with reference to FIG. 8.

In the screw compressor (1), when the electric motor (15) is started, the screw rotor (40) coupled to the driving shaft (21) rotates. The rotation of the screw rotor (40) causes the gate rotors (50) to rotate, and the compression mechanism (20) repeats a suction stroke, a compression stroke, and a discharge stroke. Here, description will be focused on the compression chamber (23) with dots in FIG. 8.

In FIG. 8(A), the compression chamber (23) with dots communicates with the low-pressure space (S1). The helical grooves (41) forming this compression chamber (23) are engaged with gates 51*b*) of a gate rotor (Sob) shown as an upper gate rotor in FIG. 8(A). When the screw rotor (40) rotates, the gates (51*b*) relatively move toward the terminal ends of the helical grooves (41), and the volume of the compression chamber (23) increases accordingly. Consequently, the low-pressure gas refrigerant in the low-pressure space (S1) is sucked in the compression chamber (23).

When the screw rotor (40) further rotates, the state shown in FIG. 8(B) is created. In FIG. 8(B), the compression chamber (23) with dots are closed. That is, the helical grooves (41) forming the compression chamber (23) are engaged with gates (51*a*) of a gate rotor (50*a*) shown as a lower gate rotor in FIG. 8(B), and are separated from the low-pressure space (S1) by theses gates (51*a*). When the gates (51*a*) move toward the terminal ends of the helical grooves (41) with the rotation of the screw rotor (40), the volume of the compression chamber (23) gradually decreases. Consequently, a refrigerant gas in the compression chamber (23) is compressed.

When the screw rotor (40) further rotates, the state shown in FIG. 8(C) is created. In FIG. 8(C), the compression chamber (23) with dots communicates with the high-pressure space (S2) through the discharge port (25). When the gates (51*a*) move toward the terminal ends of the helical grooves (41) with the rotation of the screw rotor (40), the compressed refrigerant as is discharged from the compression chamber (23) to the high-pressure space (S2).

—Operation of Changing Compression Ratio—

Operation in which the slide valve (60) changes the compression ratio of the compression mechanism (20) will now be described. The compression ratio R of the compression mechanism (20) is a value obtained by dividing the volume $V_1$ of the compression chamber (23) immediately after end of a suction stroke by the volume $V_1$ of the compression chamber (23) immediately before start of a discharge stroke (i.e., $R=V_1/V_2$). That is, the compression ratio R of the compression mechanism (20) is equivalent to the internal volume ratio of the compression mechanism (20).

Figure 3:
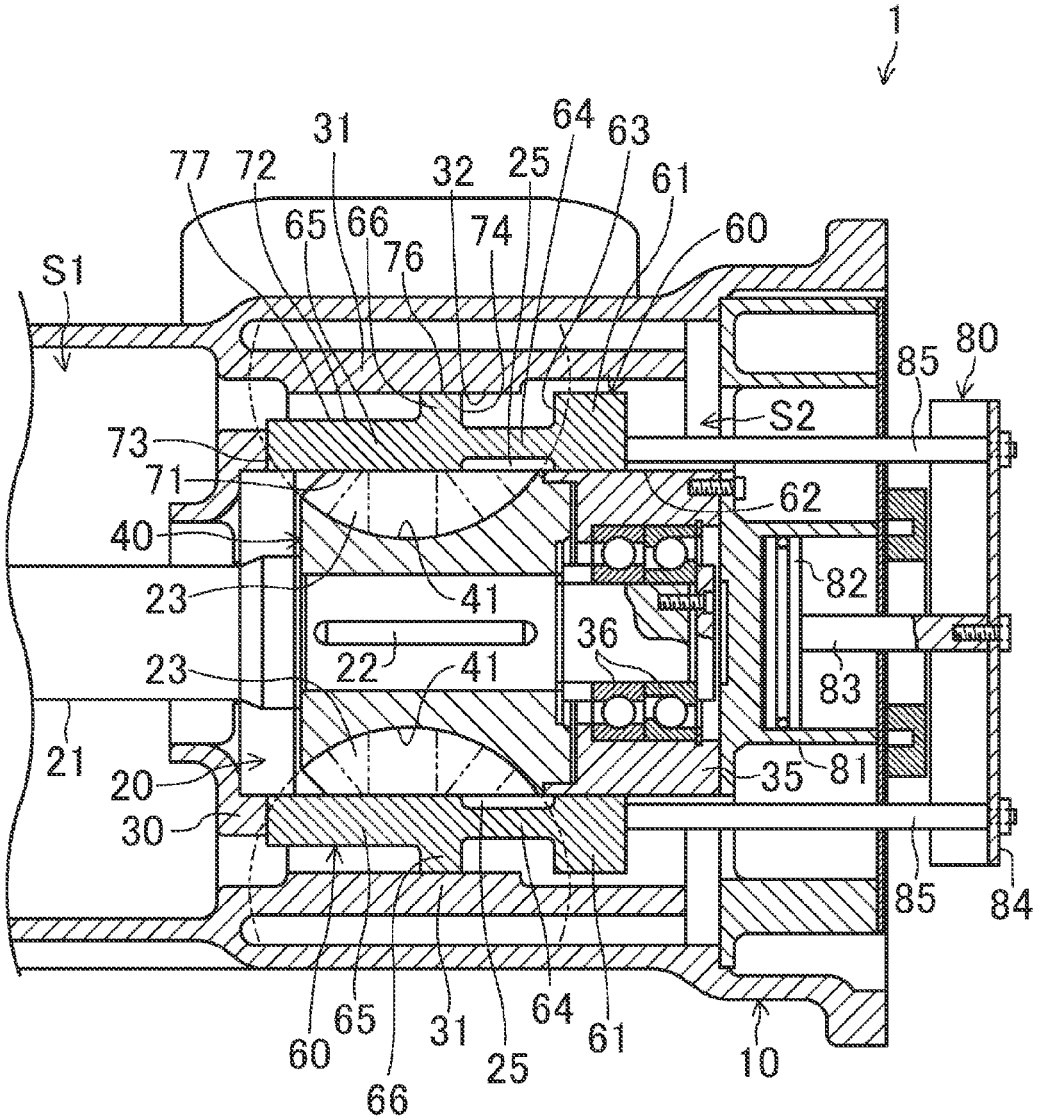
FIG. 3 is a cross-sectional view illustrating a main portion of the single-screw compressor of the first embodiment, and shows a state with the lowest compression ratio.

As illustrated in FIGS. 2 and 3, when the slide valve (60) moves, the position of the discharge port (25) moves accordingly. On the other hand, as illustrated in FIGS. 8(A)-8(C), when the screw rotor (40) rotates, the gates (51*a*) of the gate rotor (50*a*) relatively move from the start ends to the terminal ends of the helical grooves (41), and the volume of the compression chamber (23) formed by the helical grooves (41) gradually decreases. Consequently, the refrigerant in the compression chamber (23) is compressed, and the pressure of the refrigerant in the compression chamber (23) gradually increases.

Then, in a state in which the slide valve (60) is closest to the high-pressure space (S2) (i.e., at the right side in FIG. 2) as illustrated in FIG. 2, immediately before the compression chamber (23) starts communicating with the discharge port (25) (i.e., immediately before start of a discharge stroke), the volume of the compression chamber (23) is at the minimum, and the compression ratio of the compression mechanism (20) is at the maximum. On the other hand, in a state in which the slide valve (60) is closest to the low-pressure space (S1) (i.e., at the left side in FIG. 3) as illustrated in FIG. 3, immediately before the compression chamber (23) starts communicating with the discharge port (25) (i.e., immediately before start of a discharge stroke), the volume of the compression chamber (23) is at the maximum, and the compression ratio of the compression mechanism (20) is at the minimum.

—Refrigerant Pressure Applied on Slide Valve—

The refrigerant pressure applied on the slide valve (60) will be described with reference to FIGS. 2 and 3.

As described above, an end of the slide valve housing (31) communicates with the low-pressure space (S1), and the other end of the slide valve housings (31) communicates with the high-pressure space (S2). In the slide valve housing (31), the sealing projection (66) on the slide valve (60) comes in contact with the inner peripheral surface of the slide valve housing (31), thereby separating the low-pressure space (S1) and the high-pressure space (S2) from each other.

When the position of the slide valve (60) changes, the position of the sealing projection (66) also changes. Thus, in the slide valve housing (31), independently of the position of the slide valve (60), the refrigerant pressure in a portion of the slide valve housings (31) extending from the sealing projection (66) toward the low-pressure space (S1) (i.e., a left-hand portion in each of FIGS. 2 and 3) is always equal to the refrigerant pressure in the low-pressure space (S1), whereas the refrigerant pressure in a portion of the slide valve housings (31) extending from the sealing projection (66) toward the high-pressure space (S2) (i.e., a right-hand portion in each of FIGS. 2 and 3) is always equal to the refrigerant pressure in the high-pressure space (S2).

Accordingly, the refrigerant pressure in the high-pressure space (S2) is applied on the surfaces of the guide (61) and the joint (64) and the rear end surface (74) of the valve body (65). The refrigerant pressure in the low-pressure space (S1) is applied on the nonslidable-contact surface (77) and the front end surface (73) of the valve body (65). In addition, the refrigerant pressure applied on the sealing slidable-contact surface (76) as the convex surface of the sealing projection (66) is substantially equal to the refrigerant pressure in the high-pressure space (S2) at an end toward the rear end surface (74), and is substantially equal to the refrigerant pressure in the low-pressure space (S1) at the other end toward the nonslidable-contact surface (77), i.e., gradually decreases from one end to the other of the sealing slidable-contact surface (76). On the other hand, the front surface (71) of the valve body (65) faces the outer periphery of the screw rotor (40). Thus, the refrigerant pressure in the compression chamber (23) is applied on the front surface (71) of the valve body (65).

In this manner, independently of the position of the slide valve (60), the refrigerant pressure in the low-pressure space (S1) is always applied on the nonslidable-contact surface (77) occupying a large part of the back surface (72) in the valve body (65) of the slide valve (60). On the other hand, the refrigerant pressure in the compression chamber (23) is applied on the front surface (71) of the valve body (65). The refrigerant pressure in the compression chamber (23) during a compression stroke is higher than the refrigerant pressure in the low-pressure space (S1) (i.e., the pressure of a low-pressure refrigerant before being compressed). Thus, independently of the position of the slide valve (60), a force that pulls the valve body (65) away from the screw rotor (40) always acts on the valve body (65). Consequently, a phenomenon in which the valve body (65) is pushed toward the screw rotor (40) to come into contact with the screw rotor (40) during operation of the screw compressor (1) does not occur.

—Advantages of First Embodiment—

In the screw compressor (1) of this embodiment, the sealing projection (66) is formed on the valve body (65) of the slide valve (60), and is in slidable contact with the slidable-contact curved surface (32) of the casing (10), thereby separating the low-pressure space (S1) and the high-pressure space (S2) from each other. In the valve body (65) of this embodiment, the sealing projection (66) extends along the rear end surface (74).

Thus, in this embodiment, independently of the position of the slide valve (60), the refrigerant pressure in the low-pressure space (S1) is applied on the nonslidable-contact surface (77) occupying a large part of the back surface (72) of the valve body (65). Consequently, a force due to the refrigerant pressure applied on the back surface (72) of the valve body (65) (i.e., a force that pushes the valve body (65) toward the screw rotor (40)) is always constant independently of the position of the slide valve (60) as long as the refrigerant pressure in the low-pressure space (S1) does not change. Accordingly, even when the slide valve (60) is moved in order to change the compression ratio, the slide valve (60) does not approach the screw rotor (40).

Thus, in this embodiment, it is possible to reduce the clearance between the slide valve (60) and the screw rotor (40) as compared to conventional compressors, while preventing the slide valve (60) from being in contact with the screw rotor (40). As a result, the amount of leakage of a refrigerant from the compression chamber (23) through the clearance between the slide valve (60) and the screw rotor (40) can be reduced, thereby enhancing the operation efficiency of the screw compressor (1).

The refrigerant pressure in the low-pressure space (S1) is applied on the nonslidable-contact surface (77) occupying a large part of the back surface (72) of the valve body (65), whereas the pressure of a refrigerant that is being compressed in the compression chamber (23) (i.e., a refrigerant in the middle of a compression stroke) is applied on the front surface (71) of the valve body (65). Thus, during operation of the screw compressor (1), the valve body (65) of the slide valve (60) is always pushed toward the back side thereof (i.e., to the direction away from the screw rotor (40)). Consequently, it is possible to minimize the clearance between the front surface (71) of the valve body (65) and the screw rotor (40), while ensuring prevention of contact between the valve body (65) and the screw rotor (40). As a result, the amount of leakage of a refrigerant from the compression chamber (23) through the clearance between the slide valve (60) and the screw rotor (40) can be minimized, thereby further enhancing the operation efficiency of the screw compressor (1).

Figure 23:
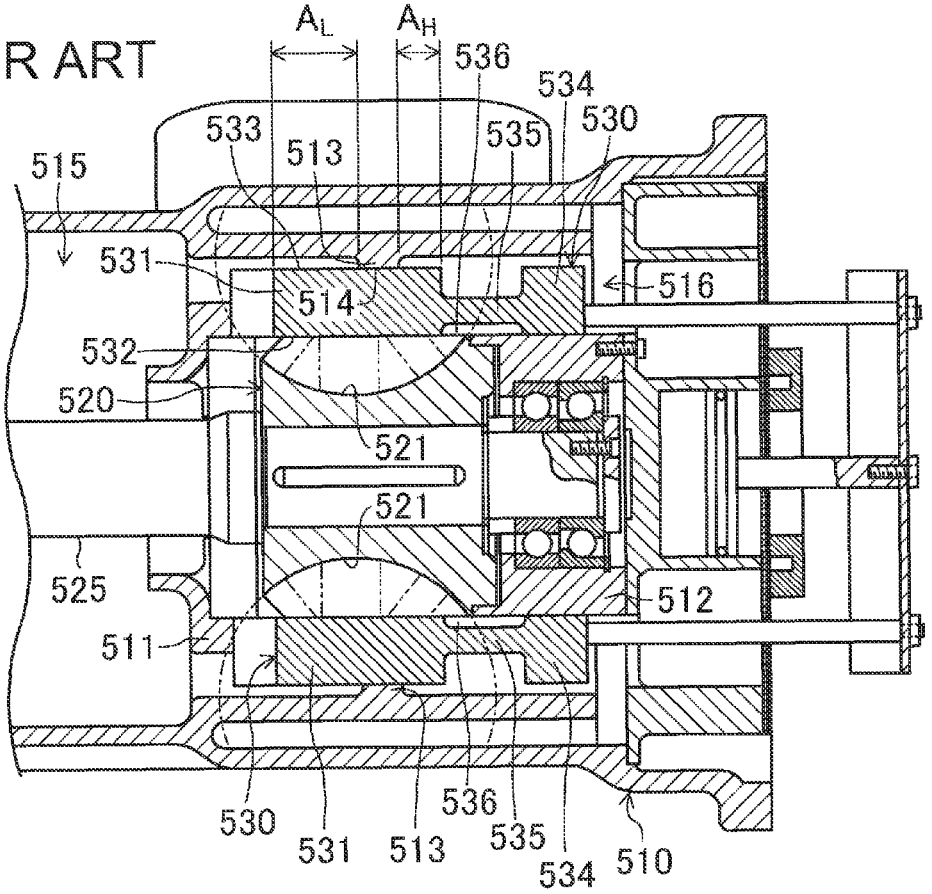
FIG.23 PRIOR ART
FIG. 23 is a cross-sectional view illustrating a main portion of a conventional single-screw compressor, and shows a state with the highest compression ratio.

As described above, in the conventional screw compressor illustrated in FIG. 23, on the back surface (533) of the valve body (531), the pressure of a fluid in the high-pressure space (516) is applied on a region extending from the projection end surface (514) of the sealing projection (513) toward the high-pressure space (516) (i.e., a region indicated as $A_H$ in FIG. 23), and the pressure of a fluid in the low-pressure space (515) is applied on a region extending from the projection end surface (514) of the sealing projection (513) toward the low-pressure space (515) (i.e., a region indicated as $A_L$ in FIG. 23). Thus, the valve body (531) is subjected to a moment of force that causes the valve body (531) to be tilted relative to the direction of movement of the valve body (531) (i.e., the lateral direction in FIG. 23). When the valve body (531) is tilted relative to its movement direction, a friction force that occurs during movement of the valve body (531) increases. Accordingly, it is difficult to stop the valve body (531) at an intended position, causing the possibility of failing to adjust the compression ratio to an appropriate value.

Figure 24:
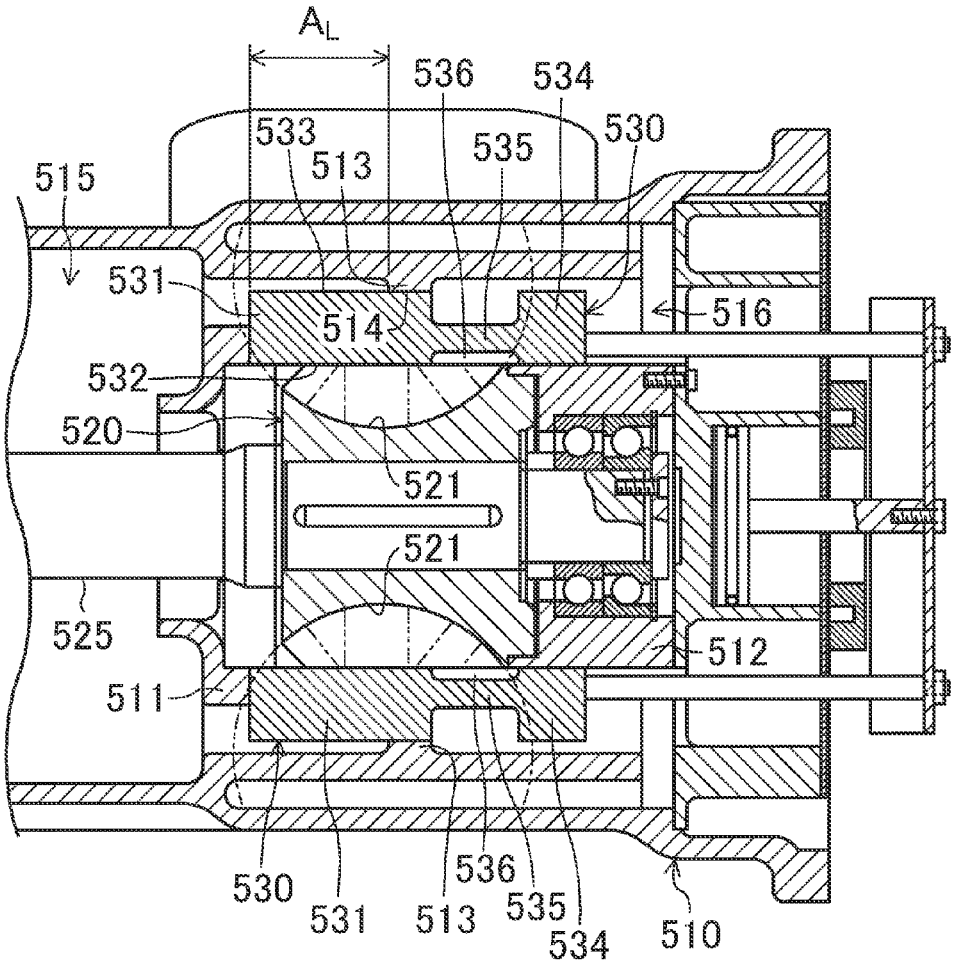
FIG.24 PRIOR ART
FIG. 24 is a cross-sectional view illustrating the main portion of the conventional single-screw compressor, and shows a state with the lowest compression ratio.
Figure 25:
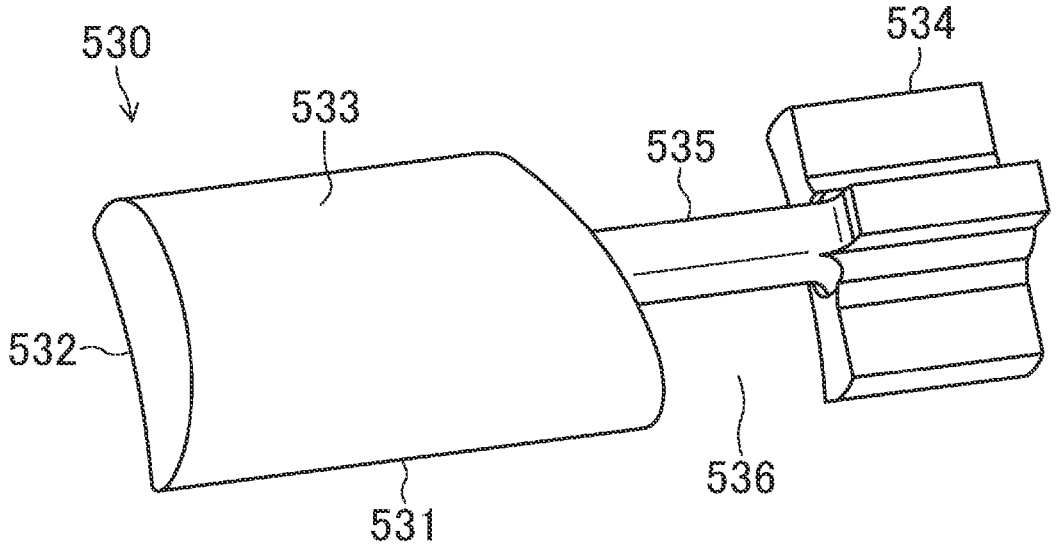
FIG.25 PRIOR ART
FIG. 25 is a perspective view illustrating a conventional slide valve.

In addition, as illustrated in FIGS. 23 and 24, in the conventional screw compressor, the area of the region of the back surface (533) of the valve body (531) on which the pressure of the fluid in the low-pressure space (515) is applied (i.e., the region indicated as $A_L$ in FIGS. 23 and 24) and the area of the region of the back surface (533) of the valve body (531) on which the pressure of the fluid in the high-pressure space (516) is applied (i.e., the region indicated as $A_H$ in FIG. 23) change depending on the position of the slide valve (530). Thus, in the conventional screw compressor, since the value of a moment due to the fluid pressure on the back surface (533) of the valve body (531) varies depending on the position of the slide valve (530), it has been more difficult to provide measures against a tilt of the valve body (531).

On the other hand, in the screw compressor (1) of this embodiment, as illustrated in FIGS. 2 and 3, independently of the position of the slide valve (60), the refrigerant pressure in the low-pressure space (S1) is always applied on the nonslidable-contact surface (77) occupying a large part of the back surface (72) of the valve body (65), and in addition, the refrigerant pressure in the high-pressure space (S2) is not applied on the back surface (72) of the valve body (65). Accordingly, in the screw compressor (1) of this embodiment, the value of a moment due to the refrigerant pressure on the back surface (72) of the valve body (65) is very small, independently of the position of the slide valve (60).

Thus, in this embodiment, independently of the position of the slide valve (60), a friction force that occurs during movement of the slide valve (60) can be made very small and kept substantially at the same value. Consequently, it is possible to stop the slide valve (60) at an intended position without fail, resulting in ensuring setting of the compression ratio of the compression mechanism (20) at an intended value.

Second Embodiment

A second embodiment of the present disclosure will be described hereinafter. A screw compressor (1) according to the second embodiment is obtained by changing the configuration of the slide valve (60) of the screw compressor (1) of the first embodiment described above. Aspects of the screw compressor (1) of the second embodiment different from those of the first embodiment will now be described.

Figure 9:
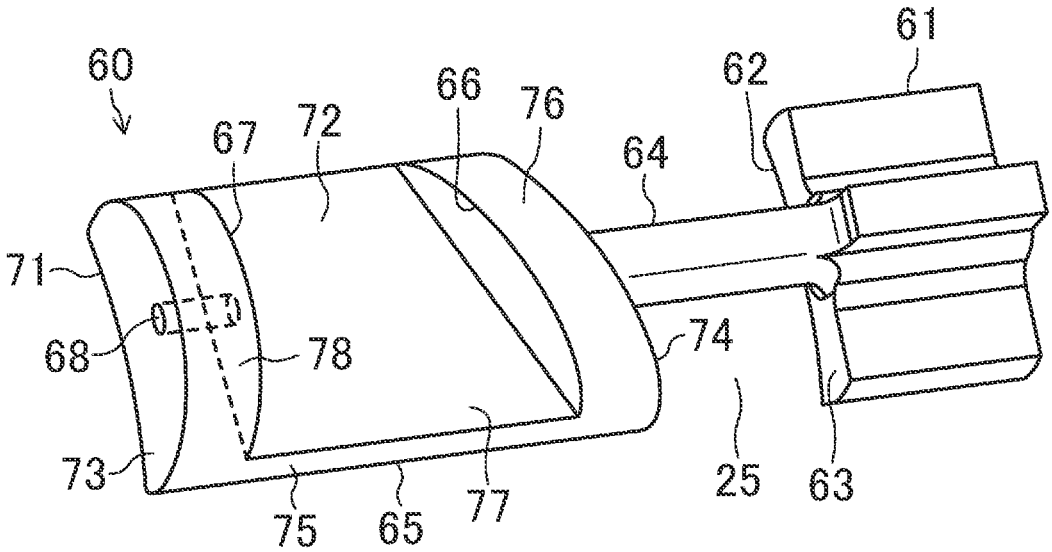
FIG. 9 is a perspective view illustrating a slide valve according to a second embodiment.

As illustrated in FIG. 9, in a slide valve (60) of this embodiment, a supporting projection (67) is added to a valve body (65). The supporting projection (67) is a portion having an arc shape on the back surface of the valve body (65), and extends along the front end of the valve body (65). That is, the supporting projection (67) projects from the back surface of the valve body (65). The convex shape of the supporting projection (67) is a cylindrical surface having a radius of curvature substantially equal to that of a slidable-contact curved surface (32) of a slide valve housing (31), and forms a supporting slidable-contact surface (78) to be in slidable contact with the slidable-contact curved surface (32). Part of a back surface (72) of the valve body (65) between a sealing projection (66) and the supporting projection (67) is a flat nonslidable-contact surface (77).

The supporting projection (67) has a pressure introduction hole (68). The pressure introduction hole (68) is a through hole penetrating the supporting projection (67) in the direction along which the slide valve (60) moves. An end of the pressure introduction hole (68) communicates with a front end surface (73) of the valve body (65), and the other end of the pressure introduction hole (68) communicates with the end surface of the supporting projection (67) facing the nonslidable-contact surface (77). The pressure introduction hole (68) constitutes a communication passage through which space sandwiched between the supporting projection (67) and the sealing projection (66) communicates with a low-pressure space (S1).

Figure 10:
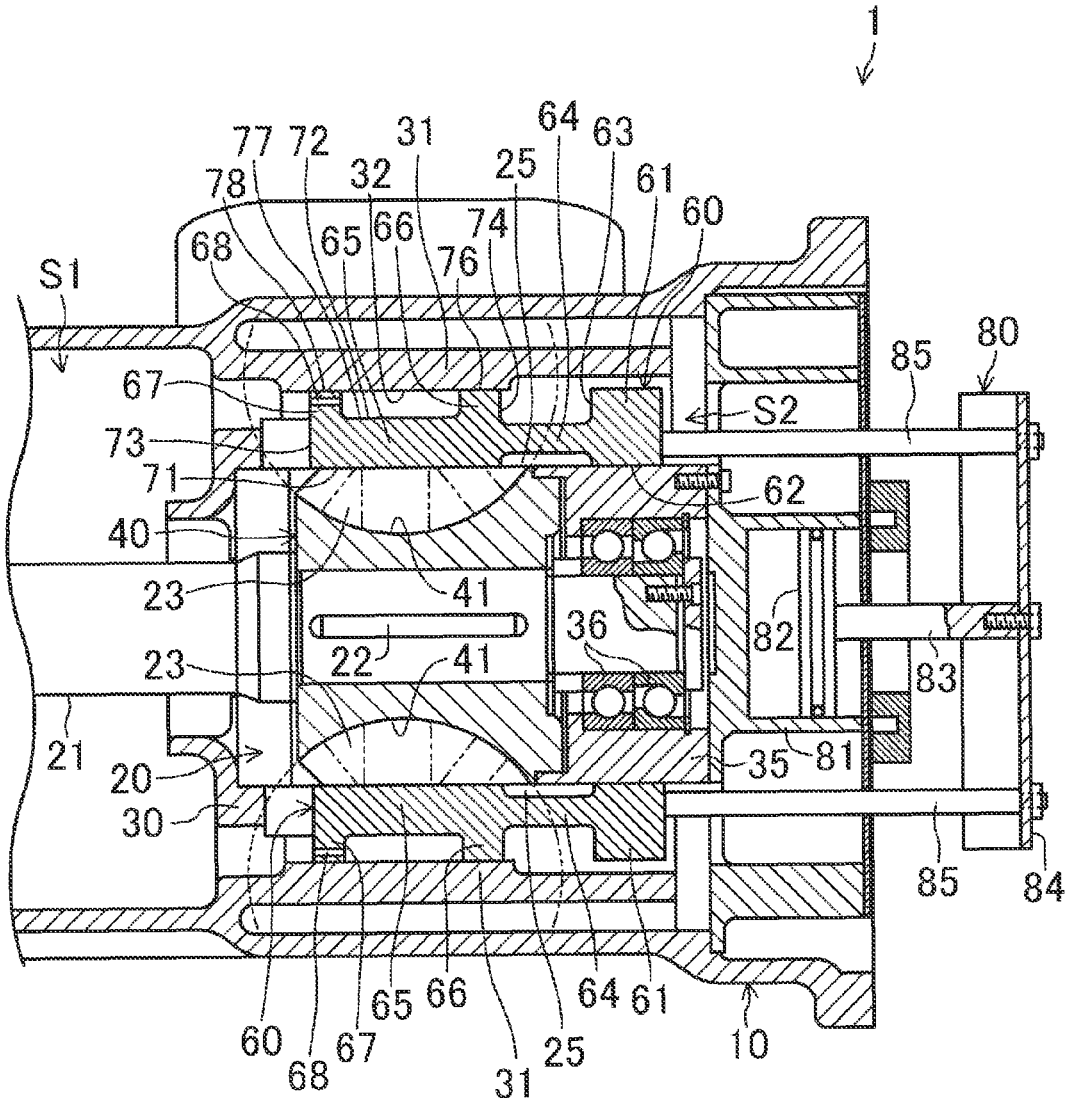
FIG. 10 is a cross-sectional view illustrating a main portion of a single-screw compressor according to the second embodiment.

As illustrated in FIG. 10, the supporting slidable-contact surface (78) of the supporting projection (67) on the valve body (65) is in slidable contact with the slidable-contact curved surface (32) constituted by the inner peripheral surface of the slide valve housing (31). It should be noted that the supporting slidable-contact surface (78) of the slide valve (60) does not need to come in physical contact with the slidable-contact curved surface (32) of a casing (10). In a compression mechanism (20) of this embodiment, an oil film is generally formed between the supporting slidable-contact surface (78) and the slidable-contact curved surface (32).

In the slide valve housing (31), space is formed by the sealing projection (66), the supporting projection (67), the nonslidable-contact surface (77), and the slidable-contact curved surface (32). This space is the space sandwiched between the sealing projection (66) and the supporting projection (67), and communicates with the low-pressure space (S1) through the pressure introduction hole (68). Thus, the pressures applied on the nonslidable-contact surface (77) and the supporting slidable-contact surface (78) are substantially equal to the refrigerant pressure in the low-pressure space (S1).

—Advantages of Second Embodiment—

As described in the first embodiment, the refrigerant pressure in a compression chamber (23) is applied on a front surface (71) of the valve body (65) of the slide valve (60). Thus, a force that pushes the valve body (65) against the slidable-contact curved surface (32) acts on the valve body (65).

On the other hand, in this embodiment, both of the supporting projection (67) extending along the front end surface (73) of the valve body (65) and the sealing projection (66) extending along the rear end surface (74) of the valve body (65) are in slidable contact with the slidable-contact curved surface (32) that is the inner peripheral surface of the slide valve housing (31). Thus, the valve body (65) pushed toward the back by the refrigerant in the compression chamber (23) is supported by the sealing projection (66) and the supporting projection (67) both of which are in slidable contact with the casing (10). Accordingly, in this embodiment, deformation of the valve body (65) due to the refrigerant pressure in the compression chamber (23) can be reduced. As a result, enlargement of the clearance between the valve body (65) and a screw rotor (40) due to deformation of the valve body (65) can be reduced, thereby maintaining a high operation efficiency of the screw compressor (1).

—Variation of Second Embodiment—

In this embodiment, the pressure introduction hole (68) may be replaced by a pressure introduction groove (69) formed on the supporting projection (67). That is, in the valve body (65) of this variation, the pressure introduction groove (69) is provided as a communication passage.

Figure 11:
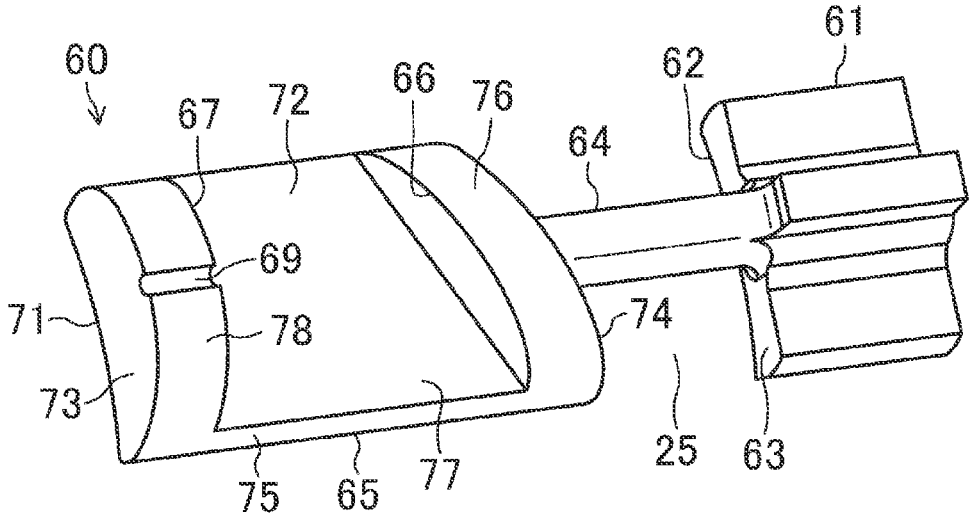
FIG. 11 is a perspective view illustrating a slide valve according to a variation of the second embodiment.

As illustrated in FIG. 11, the pressure introduction groove (69) is a concave groove having an opening at the supporting slidable-contact surface (78), and extends from the front end surface (73) of the valve body (65) to the end surface of the supporting projection (67) facing the nonslidable-contact surface (77). In this variation, in the slide valve housing (31), space is also formed by the sealing projection (66), the supporting projection (67), the nonslidable-contact surface (77), and the slidable-contact curved surface (32). This space communicates with the low-pressure space (S1) through the pressure introduction groove (69). Thus, in this variation, the pressures on the nonslidable-contact surface (77) and the supporting slidable-contact surface (78) are also substantially equal to the refrigerant pressure in the low-pressure space (S1).

Third Embodiment

A third embodiment of the present disclosure will be described hereinafter. A screw compressor (1) according to the third embodiment is obtained by changing the configuration of the slide valve (60) of the screw compressor (1) of the second embodiment described above. Aspects of the screw compressor (1) of the third embodiment different from those of the second embodiment will now be described.

Figure 12:
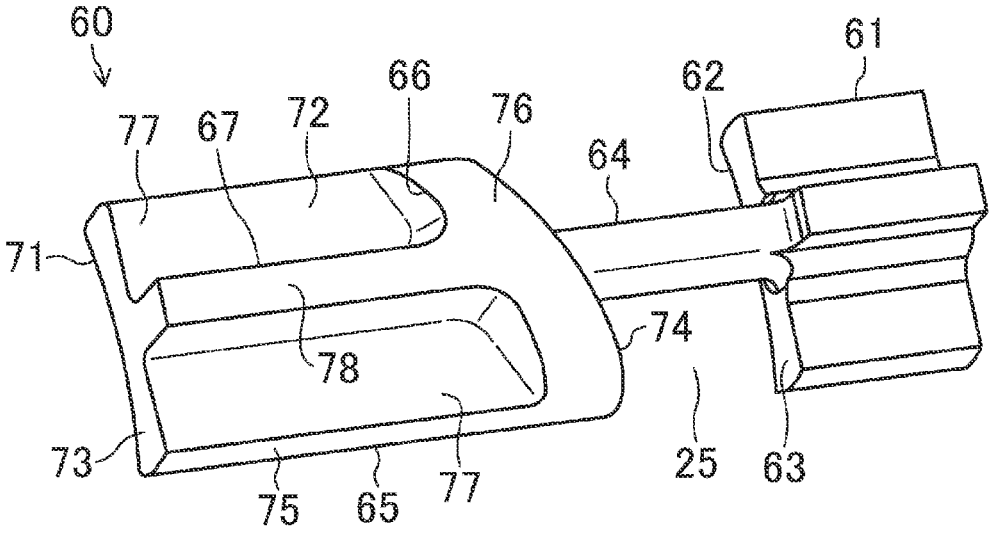
FIG. 12 is a perspective view illustrating a slide valve according to a third embodiment.

As illustrated in FIG. 12, in a slide valve (60) according to this embodiment, the shape of a supporting projection (67) is different from that of the second embodiment. The supporting projection (67) of this embodiment is a slender projection formed along the axis of a valve body (65) (i.e., along the direction of movement of the slide valve (60)), and extends from a sealing projection (66) to a front end surface (73) of the valve body (65). The supporting projection (67) of this embodiment is located in the middle of the valve body (65) in the width direction (i.e., the direction orthogonal to the axis of the valve body (65)). The width of the supporting projection (67) is substantially constant across the overall length thereof. The projection end surface of the supporting projection (67) is a cylindrical surface having a radius of curvature substantially equal to that of a slidable-contact curved surface (32) of a slide valve housing (31), and the entire projection end surface of the supporting projection (67) constitutes a supporting slidable-contact surface (78) to be in slidable contact with the slidable-contact curved surface (32). On a back surface (72) of the valve body (65) of this embodiment, regions at the sides of the supporting projection (67) are nonslidable-contact surfaces (77).

Figure 13:
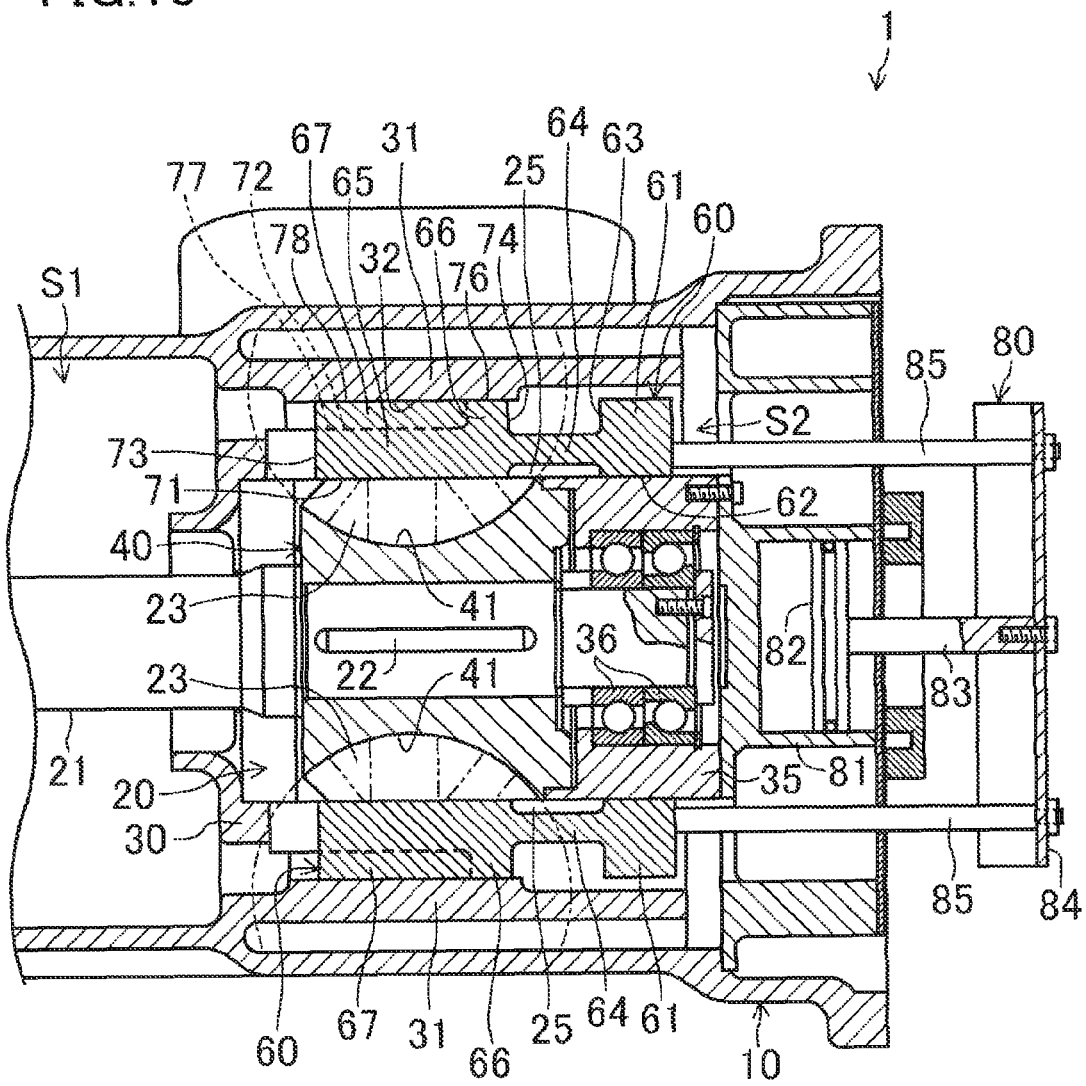
FIG. 13 is a cross-sectional view illustrating a main portion of a single-screw compressor according to the third embodiment.

As illustrated in FIG. 13, in a state in which the slide valve (60) is inserted in the slide valve housing (31), both of a sealing slidable-contact surface (76) of the sealing projection (66) and the supporting slidable-contact surface (78) of the supporting projection (67) are in slidable contact with the slidable-contact curved surface (32) constituted by the inner peripheral surface of the slide valve housing (31). Thus, the valve body (65) pushed toward the back surface (72) by the refrigerant in a compression chamber (23) is supported on a casing (10) across the overall length thereof from the front end surface (73) to a rear end surface (74). Accordingly, in this embodiment, deformation of the valve body (65) due to the refrigerant pressure in the compression chamber (23) can be reduced. As a result, enlargement of a clearance between the valve body (65) and a screw rotor (40) due to deformation of the valve body (65) can be reduced, thereby maintaining a high operation efficiency of the screw compressor (1).

The valve body (65) of the slide valve (60) faces the outer periphery of the screw rotor (40). Thus, the refrigerant pressure in the compression chamber (23) formed by helical grooves (41) on the screw rotor (40) is applied on a front surface (71) of the valve body (65). On the other hand, the refrigerant pressure in the compression chamber (23) gradually increases as the compression chamber (23) approaches a discharge port (25). Thus, a higher refrigerant pressure in the compression chamber (23) is applied on the front surface (71) of the valve body (65) as the distance to the rear end close to the discharge port (25) decreases.

On the other hand, in the valve body (65) of the slide valve (60) of this embodiment, the supporting projection (67) on the back surface of the valve body (65) extends from the front end to the sealing projection (66) of the valve body (65). Thus, in this embodiment, the rigidity of a portion of the valve body (65) near the rear end surface (74) is higher than those of the valve bodies (65) in the first and second embodiments. Specifically, in this embodiment, a portion of the valve body (65) near the rear end surface (74) where a high refrigerant pressure is applied on the front surface (71) has a high rigidity, and thus, the degree of deformation of this portion near the rear end surface (74) can be reduced.

Consequently, in this embodiment, the difference in deformation degree between a portion of the valve body (65) near the front end surface (73) and a portion of the valve body (65) near the rear end surface (74) decreases, as compared to the first and second embodiments, thereby uniformizing the degree of deformation of the valve body (65) due to the refrigerant pressure in the compression chamber (23) in the entire valve body (65). Thus, in this embodiment, a clearance between the front surface (71) of the valve body (65) and the screw rotor (40) can be uniformized in the entire valve body (65). As a result, the amount of leakage of a refrigerant from the compression chamber (23) can be further reduced, thereby further enhancing the operation efficiency of the screw compressor (1).

—First Variation of Third Embodiment—

Figure 14:
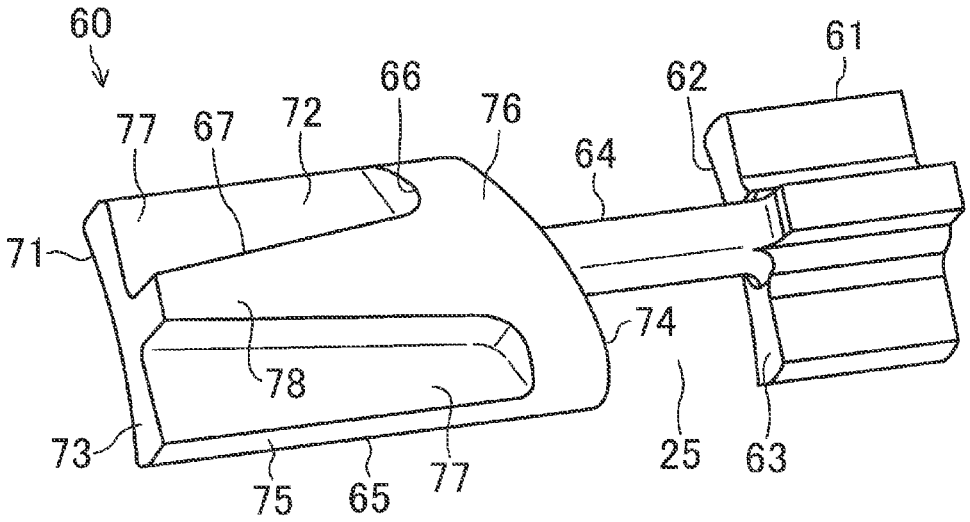
FIG. 14 is a perspective view illustrating a slide valve according to a first variation of the third embodiment.
Figure 15:
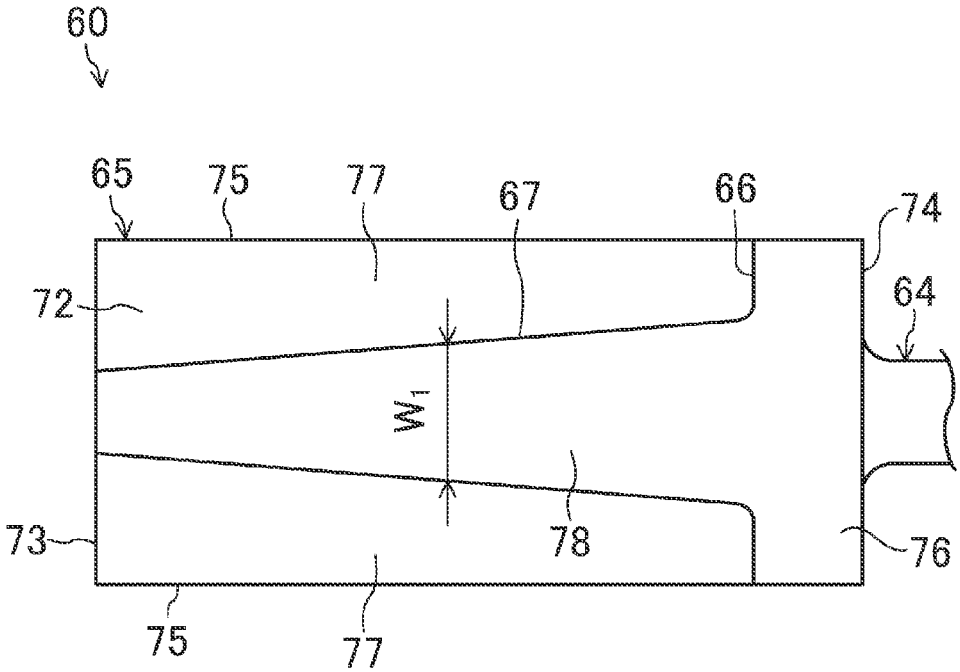
FIG. 15 is a plan view illustrating a main portion of the slide valve of the first variation of the third embodiment.

As illustrated in FIGS. 14 and 15, in the valve body (65) of the slide valve (60) of this embodiment, the width $W_1$ of the supporting projection (67) may gradually increase from the front end surface (73) to the sealing projection (66) of the valve body (65). That is, the width $W_1$ of the supporting projection (67) of this first variation decreases with decreasing distance to the front end surface (73) of the valve body (65), and increases with decreasing distance to the sealing projection (66). In addition, the entire projection end surface of the supporting projection (67) of the first variation serves as the supporting slidable-contact surface (78) to be in slidable contact with the slidable-contact curved surface (32).

The supporting projection (67) is a projection on the back surface of the valve body (65). Thus, as the width of the supporting projection (67) increases, a thick portion of the valve body (65) is enlarged and has its rigidity increased. Accordingly, the rigidity of the valve body (65) of this variation increases as the width of the supporting projection (67) increases with decreasing distance to the rear end surface (74).

Specifically, the rigidity of a portion of the valve body (65) of this variation where the refrigerant pressure applied on the front surface (71) is high is higher than the rigidity in a configuration in which the supporting projection (67) has a constant width (see FIG. 12). Thus, in this variation, the clearance between the front surface (71) of the valve body (65) and the screw rotor (40) can be further uniformized in the entire valve body (65). As a result, the amount of leakage of a refrigerant from the compression chamber (23) can be further reduced, thereby further enhancing the operation efficiency of the screw compressor (1).

—Second Variation of Third Embodiment—

In the valve body (65) of the first variation illustrated in FIGS. 14 and 15, only part of the projection end surface of the supporting projection (67) may serve as the supporting slidable-contact surface (78) to be in slidable contact with the slidable-contact curved surface (32).

Figure 16:
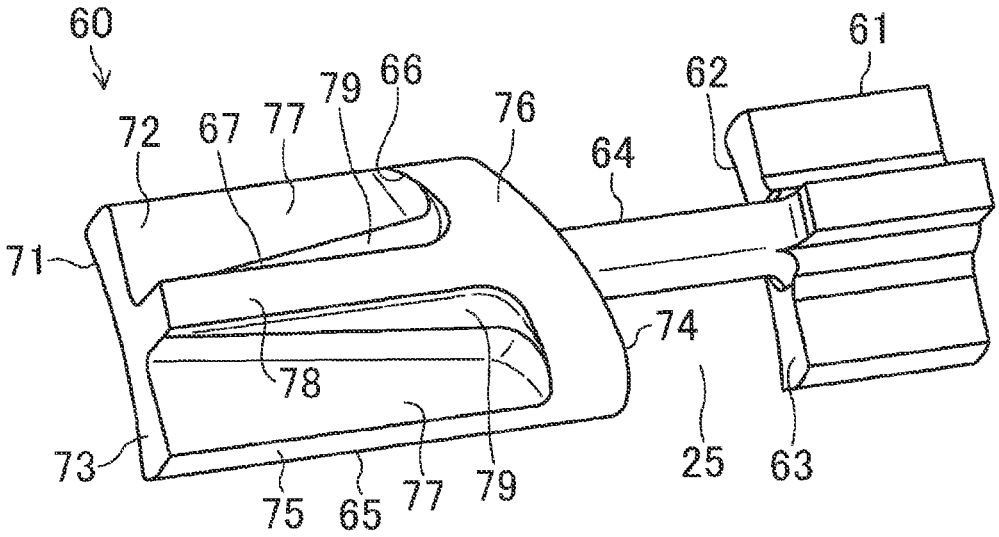
FIG. 16 is a perspective view illustrating a slide valve according to a second variation of the third embodiment.
Figure 17:
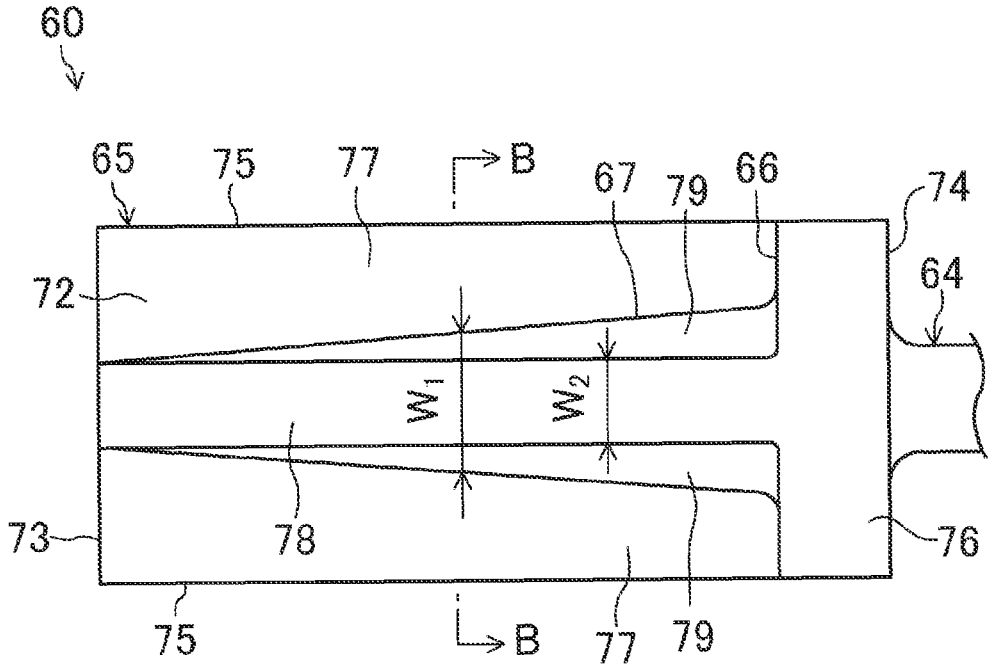
FIG. 17 is a plan view illustrating a main portion of the slide valve of the second variation of the third embodiment.
Figure 18:
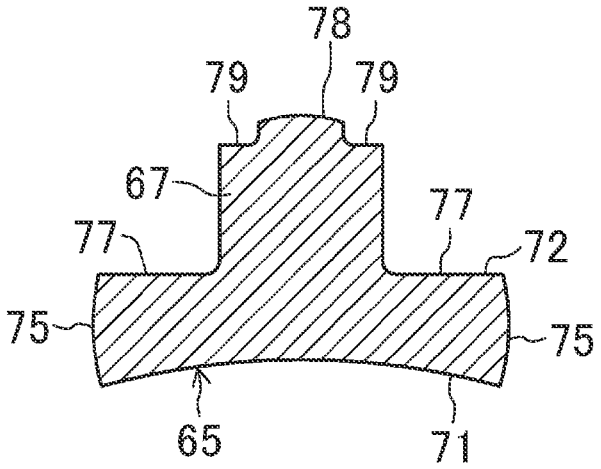
FIG. 18 is a cross-sectional view illustrating a valve body and taken along line B-B icy FIG. 17.

As illustrated in FIGS. 16-18, in this variation, only part of the projection end surface of the supporting projection (67) located at the middle in the width direction serves as the supporting slidable-contact surface (78). The width $W_2$ of the supporting slidable-contact surface (78) is substantially constant across the overall length of the supporting projection (67). In the same manner as in the first variation, the width $W_1$ of the supporting projection (67) gradually increases from the front end surface (73) to the sealing projection (66) of the valve body (65). The heights of portions of the supporting projection (67) located at both sides of the supporting slidable-contact surface (78) are lower than that of a portion constituting the supporting slidable-contact surface (78). The projection end surfaces of the portions of the supporting projection (67) located at both sides of the supporting slidable-contact surface (78) serve as nonslidable-contact projection surfaces (79) that are not in slidable contact with the slidable-contact curved surface (32). That is, in the valve body (65) of this variation, the nonslidable-contact projection surfaces (79) are formed at both sides of the supporting slidable-contact surface (78) in the projection end surface of the supporting projection (67).

In the valve body (65) of this variation, the refrigerant pressure applied on the nonslidable-contact projection surfaces (79) of the supporting projection (67) is substantially equal to the refrigerant pressure in the low-pressure space (S1). That is, in the valve body (65) of this variation, the refrigerant pressure in the low-pressure space (S1) is applied on both of the nonslidable-contact surface (77) and the nonslidable-contact projection surface (79). Accordingly, even in a configuration in which the width $W_1$ of the supporting projection (67) is increased in order to reduce the degree of deformation of the valve body (65), the area of a portion of the surface of the valve body (65) on which the refrigerant pressure in the low-pressure space (S1) is applied can be reduced substantially to the same degree as a configuration in which the width of the supporting projection (67) is constant (see FIG. 12). Accordingly, in this variation, it is possible to reduce a force that pushes the slide valve (60) toward the screw rotor (40), while reducing the degree of deformation of the valve body (65) by increasing the width $W_1$ of the supporting projection (67).

OTHER EMBODIMENTS

Modifications of the foregoing embodiments will be described hereinafter.

First Modification

In each of the slide valves (60) of the foregoing embodiments, the thickness of the valve body (65) may gradually increase from the front end surface (73) to the sealing projection (66) of the valve body (65). The valve body (65) of this modification will now be described with reference to FIGS. 19-22.

Figure 19:
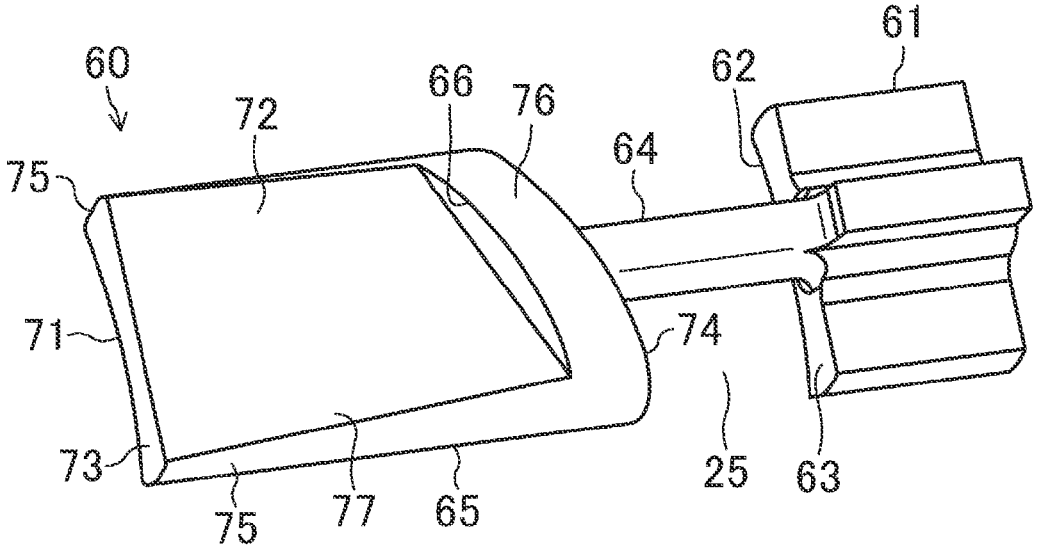
FIG. 19 is a perspective view illustrating a slide valve in the case of applying a first modification of other embodiments to the first embodiment.

FIG. 19 illustrates the case of applying this modification to the slide valve (60) of the first embodiment illustrated in FIG. 6. In the valve body (65) of the slide valve (60) illustrated in FIG. 19, the thickness t of a portion of the valve body (65) extending from the sealing projection (66) to the front end thereof gradually increases from the front end surface (73) to the sealing projection (66) of the valve body (65).

Figure 20:
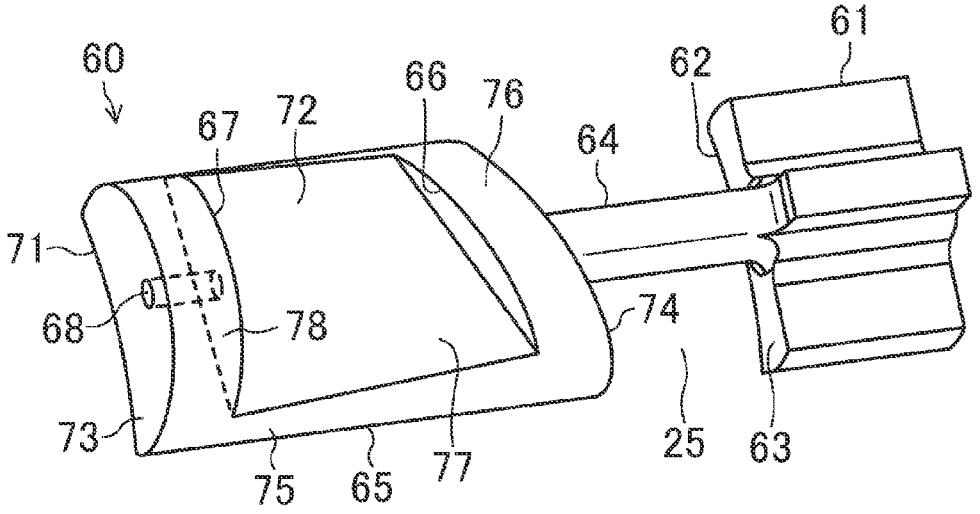
FIG. 20 is a perspective view illustrating a slide valve in the case of applying the first modification of other embodiments to the second embodiment.

FIG. 20 illustrates the case of applying this modification to the slide valve (60) of the second embodiment illustrated in FIG. 9. In the valve body (65) of the slide valve (60) illustrated in FIG. 20, the thickness t between the supporting projection (67) and the sealing projection (66) gradually increases from the front end surface (73) to the sealing projection (66) of the valve body (65).

Figure 21:
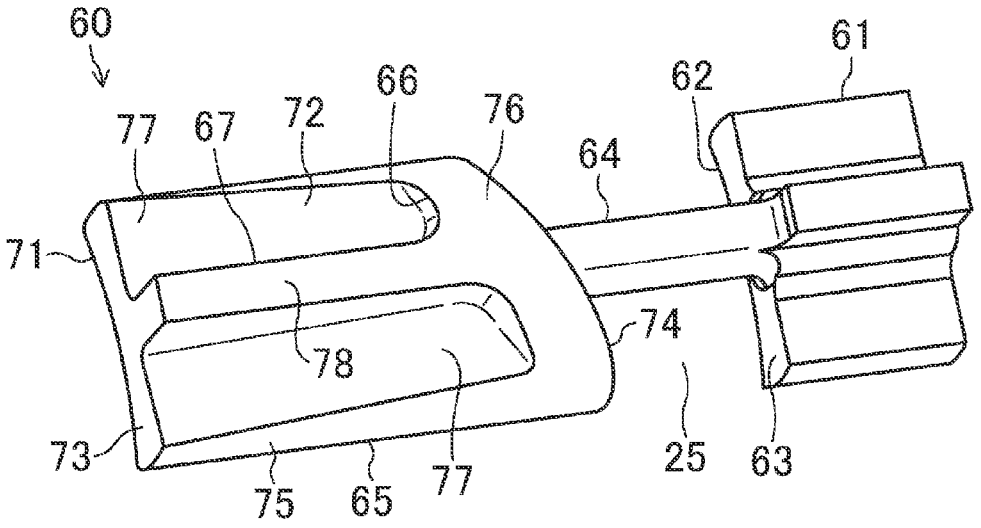
FIG. 21 is a perspective view illustrating a slide valve in e case of applying the first modification of other embodiments to the third embodiment.
Figure 22:
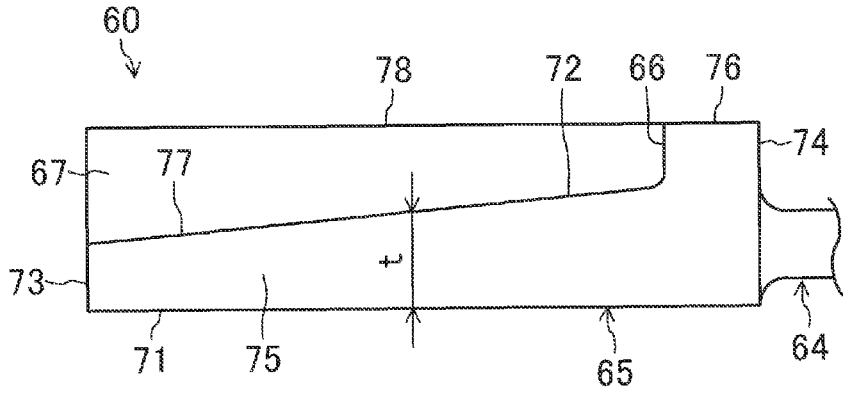
FIG. 22 is a side view illustrating a slide valve in the case of applying the first modification of other embodiments to the third embodiment.

FIG. 21 illustrates the case of applying this modification to the slide valve (60) of the third embodiment illustrated in FIG. 12. In the valve body (65) of the slide valve (60) illustrated in FIG. 21, the thickness t of each of portions located at both sides of the supporting projection (67) gradually increases from the front end surface (73) to the sealing projection (66) of the valve body (65). This modification is also applicable to the first and second variations of the third embodiment.

As described above, in the valve body (65) of the first modification, the thickness t of a portion constituting the nonslidable-contact surface (77) gradually increases from the front end surface (73) to the rear end surface (74) of the valve body (65). That is, the thickness t of a portion of the valve body (65) constituting the nonslidable-contact surface (77) decreases with decreasing distance to the front end surface (73) of the valve body (65), and increases with decreasing distance to the rear end surface (74) of the valve body (65).

As described in the third embodiment, the refrigerant pressure in the compression chamber (23) applied on the front surface (71) of the valve body (65) increases as the distance to the rear end close to the discharge port (25) decreases. On the other hand, in the valve body (65) of the first modification, the thickness t of a portion constituting the nonslidable-contact surface (77) gradually increases with decreasing distance to the rear end surface (74) of the valve body (65). The rigidity of the valve body (65) increases with increasing thickness of the valve body (65). Thus, a portion of the valve body (65) of the first modification near the rear end surface (74) where the refrigerant pressure applied on the front surface (71) is high has a high rigidity, and thus, the degree of deformation of this portion near the rear end surface (74) can be reduced.

Consequently, in the first modification, the clearance between the front surface (71) of the valve body (65) and the screw rotor (40) can be uniformized in the entire valve body (65). As a result, the amount of leakage of a refrigerant from the compression chamber (23) can be further reduced, thereby further enhancing the operation efficiency of the screw compressor (1).

Second Modification

In the foregoing embodiments, the present disclosure is applied to single-screw compressors. Alternatively, the present disclosure may be applied to twin-screw compressors.

INDUSTRIAL APPLICABILITY

As described above, the present disclosure is useful for screw compressors.

What is claimed is:

1. A screw compressor, comprising:

a casing having a low-pressure space and a high-pressure space formed therein;

a screw rotor having a plurality of helical grooves forming a compression chamber, the screw rotor being configured to be inserted in a cylinder part of the casing; and a slide valve disposed in the cylinder part, the slide valve being moveable along an axis of the screw rotor and facing an outer periphery of the screw rotor to form a discharge port communicating the compression chamber with the high-pressure space, a fluid in the low-pressure space being sucked into the compression chamber, compressed, and then discharged to the high-pressure space when the screw rotor rotates, a slide valve housing being formed in the casing, the slide valve being placed in the slide valve housing, the slide valve housing having a concave groove shape extending along an axis of the cylinder part, and an inner surface of the slide valve housing being cylindrical, the slide valve including a sealing projection located on a back surface of the slide valve opposite to the screw rotor and separating the low-pressure space and the high-pressure space from each other when the sealing projection is in slidable contact with the inner surface of the slide valve housing, a portion of the slide valve extending from the discharge port toward the low-pressure space serving as a valve body, the valve body having a front end facing the low-pressure space and a rear end facing the discharge port, the sealing projection extending along the rear end of the valve body, the valve body including a supporting projection located on the back surface of the valve body and configured to be in slidable contact with the casing, the supporting projection being disposed on a portion of the valve body extending from the sealing projection to the front end, and the supporting projection extending from the sealing projection to the front end of the valve body and being disposed in a middle of the valve body in a width direction orthogonal to a direction along which the slide valve slides, on the back surface of the valve body, flat nonslidable-contact surfaces are arranged on respective sides in the width direction of the supporting projection, the flat nonslidable-contact surfaces being not in slidable contact with the casing, and a projection end surface of the supporting projection and side surfaces, of the valve body, located on respective sides in the width direction of the valve body being cylindrical surfaces in slidable contact with the inner surface of the slide valve housing.

2. The screw compressor of claim 1, wherein a thickness of the valve body increases from the front end of the valve body to the sealing projection.

3. The screw compressor of claim 1, wherein a width of the supporting projection gradually increases from the front end of the valve body to the sealing projection.

4. The screw compressor of claim 1, wherein only a part, in a width direction, of a projection end surface of the supporting projection serves as a supporting slidable-contact surface configured to be in slidable contact with the casing.

5. The screw compressor of claim 2, wherein a width of the supporting projection gradually increases from the front end of the valve body to the sealing projection.

6. The screw compressor of claim 2, wherein only a part, in a width direction, of a projection end surface of the supporting projection serves as a supporting slidable-contact surface configured to be in slidable contact with the casing.

* * * * *